US008187395B2

(12) United States Patent
Uemura et al.

(10) Patent No.: US 8,187,395 B2
(45) Date of Patent: May 29, 2012

(54) ELECTRICAL CONTACT HAVING HIGH ELECTRICAL CONDUCTIVITY MADE OF INTERNALLY OXIDIZED SILVER-OXIDE MATERIAL FOR COMPACT ELECTROMAGNETIC RELAY

(75) Inventors: Yuzo Uemura, Susono (JP); Koshiro Ueda, Sunto-gun (JP); Noriaki Murahashi, Sunto-gun (JP); Shinji Yamanashi, Susono (JP); Michio Taki, Susono (JP); Hiroyasu Endo, Mishima (JP)

(73) Assignee: Mitsubishi Materials C.M.I. Corporation, Susono-Shi (JP)

( * ) Notice: Subject to any disclaimer, the term of this patent is extended or adjusted under 35 U.S.C. 154(b) by 758 days.

(21) Appl. No.: 10/913,863

(22) Filed: Aug. 6, 2004

(65) Prior Publication Data

US 2005/0028896 A1 Feb. 10, 2005

(30) Foreign Application Priority Data

| | | |
|---|---|---|
| Aug. 8, 2003 | (JP) | 2003-289820 |
| Dec. 1, 2003 | (JP) | 2003-401296 |
| Dec. 1, 2003 | (JP) | 2003-401297 |
| Dec. 1, 2003 | (JP) | 2003-401298 |
| Dec. 1, 2003 | (JP) | 2003-401299 |

(51) Int. Cl.
*C22C 5/06* (2006.01)

(52) U.S. Cl. ..... 148/431; 200/266

(58) Field of Classification Search ..... 148/431, 148/678; 200/266

See application file for complete search history.

(56) References Cited

U.S. PATENT DOCUMENTS 3,933,485 A 1/1976 Shibata et al.

(Continued)

FOREIGN PATENT DOCUMENTS

GB 2055398 A * 3/1981

(Continued)

OTHER PUBLICATIONS

"ASM Handbook: vol. 2 Properties and Selection Nonferrous Alloys and Special Purpose Materials", 2002, 'Composite Manufacturing Methods' and 'Composite Materials', p. 1-15.*

(Continued)

*Primary Examiner* — Roy King
*Assistant Examiner* — Janelle Morillo
(74) *Attorney, Agent, or Firm* — Leason Ellis LLP.

(57) ABSTRACT

Disclosed is an electrical contact having high electrical conductivity for a compact electromagnetic relay including an internally oxidized silver-oxide material which is prepared by subjecting an Ag alloy having a composition consisting essentially of, by weight, 5.1 to 9% Sn, 1.5 to 5% In, and 0.005 to 0.06% Bi, with the balance being Ag and unavoidable impurities, to an internal oxidation treatment and then subjecting to a heat treatment for diffusion, aggregation, and growth of precipitated oxides, wherein the internally oxidized silver-oxide material has a metallographic structure such that coarse grains of composite oxides are dispersed and distributed in an Ag matrix, the coarse grains of composite oxides being formed as a result of coarsening of ultra-fine grains of Sn-based oxides and ultra-fine grains of In-based oxides, which are precipitated by the internal oxidation treatment, by the heat treatment for diffusion, aggregation, and growth of the precipitated oxides.

8 Claims, 7 Drawing Sheets

U.S. PATENT DOCUMENTS

| | | | | |
|---|---|---|---|---|
| 4,141,727 | A | 2/1979 | Shida et al. | |
| 4,636,270 | A | 1/1987 | Shibata | |
| 4,680,162 | A | 7/1987 | Shibata | |
| 5,451,272 | A * | 9/1995 | Uemura et al. | 148/431 |
| 5,798,468 | A | 8/1998 | Weise et al. | |

FOREIGN PATENT DOCUMENTS

| | | |
|---|---|---|
| JP | 51-55989 | 5/1976 |
| JP | 54-137425 | 1/1980 |
| JP | 55-4825 | 2/1980 |
| JP | 61-47894 | 10/1986 |
| JP | 04-314837 | 11/1992 |
| JP | 08-073966 | 3/1996 |
| JP | 2001-355028 | 8/2002 |

OTHER PUBLICATIONS

"Influence of Small Alloying Additions on the Internal Oxidation and the Switching Behavior of AgSnIn-Alloys" by Bohm et al., vol. 2, pp. 905-914 at Proceedings of 10th International Conference on Electric Contact Phenomena in 1980.

Patent Abstracts of Japan for JP04-314837 published on Nov. 6, 1992.

Patent Abstracts of Japan for JP55-4825 published on Feb. 1, 1980.

Patent Abstracts of Japan for JP51-55989 published on May 17, 1976.

Patent Abstracts of Japan for JP61-47894 published on Oct. 21, 1986.

Patent Abstracts of Japan for JP54-137425 published on Jan. 9, 1980.

Patent Abstracts of Japan for JP2001-355028 published on Aug. 4, 2002.

* cited by examiner

ELECTRICAL CONTACT HAVING HIGH ELECTRICAL CONDUCTIVITY MADE OF INTERNALLY OXIDIZED SILVER-OXIDE MATERIAL FOR COMPACT ELECTROMAGNETIC RELAY

BACKGROUND OF THE INVENTION

1. Field of the Invention

The present invention relates to an electrical contact including an internally oxidized silver-oxide material which has high electrical conductivity and excellent electrical contact characteristics over a long period of time in the form of a compact element, that is, one which exhibits high welding resistance and high wear resistance and is suitable for an electromagnetic relay which is made smaller in size.

This application claims priority from Japanese Patent Application No. 2003-289820 filed on Aug. 8, 2003, and Japanese Patent Applications Nos. 2003-401296, 2003-401297, 2003-401298 and 2003-401299 filed on Dec. 1, 2003, the contents of which are incorporated herein by reference.

2. Background Art

Various electromagnetic relays are used as functional components of automobiles, office equipments, etc.

The electromagnetic relay 100 is constituted, for example, from an electromagnet 101 including an iron core 111 and a coil 112, an armature lever 102 having a substantially L-shaped section, a movable contact spring 141 and a stationary contact spring 142 that are provided above the armature lever 102, and electrical contacts 151 and 152 fixed at one end each of the movable contact spring 141 and the stationary contact spring 142 opposing each other, as shown in schematic longitudinal sectional views of FIG. 6A and FIG. 6B.

At least a part of the electromagnet 101 is covered by a yoke 103, with an insulator 106 provided on the top surface of the yoke 103. Other ends of the movable contact spring 141 and of the stationary contact spring 142 are secured on the insulator 106. A return spring 143 is provided above the stationary contact spring 142, while one end of the return spring 143 is secured on the insulator 106. A contact drive card 107 is provided in contact with the movable contact spring 141 between the armature lever 102 and the return spring 143.

When an electric current flows in the coil 112 of the electromagnet 101, one end 102*a* of the armature lever 102 is attracted by the iron core 111 as shown in FIG. 6B. Thus, the armature lever 102 swings around an armature hinge 102*c*, so that the other end 102*b* of the armature lever 102 causes one end 141*a* of the movable contact spring 141 to move upward via the contact drive card 107. Consequently, the electrical contact 151 fixed at the distal end of the movable contact spring 141 and the electrical contact 152 fixed at the distal end of the stationary contact spring 142 make contact with each other so that current flows therethrough, resulting in the active state of the relay.

When the flow of the current in the coil 112 of the electromagnet 101 is stopped, the electrical contacts 151 and 152 separate from each other so that the relay rests in the inactive state shown in FIG. 6A.

In the case of the electromagnetic relay 100 having the structure described above, it is used under the conditions of 14 VDC for the power voltage and rated current of 20 to 30 A, if it is used in an automobile. In this case, the electrical contact usually has a rivet-shape measuring 3 to 5 mm in diameter.

Recently, automobiles and office equipment have been rapidly acquiring versatile functions and high performance, while growing smaller in size and lighter in weight. Accordingly, the electromagnetic relays that are functional components of automobile, office equipment, etc., are also becoming smaller in size. Thus, the electrical contacts used in the electromagnetic relay have been becoming smaller in size, and are required to have a head diameter in a range from 1.5 to 2.5 mm in the case of a rivet-shaped one.

Even when made smaller in size, the electromagnetic relay must operate under the same conditions as those of the conventional ones, that is, under conditions of 14 VDC for the power voltage and rated current of 20 to 30 A in the case of automotive application. Thus, the current density flowing in the electrical contact per unit area becomes much higher as the contact is made smaller.

Various materials have been proposed and commercialized for the electrical contacts used in the electromagnetic relay having the structure described above. Among these, internally oxidized silver-oxide material that has a metallographic structure such that ultra-fine grains of Sn-based oxides and ultra-fine grains of In-based oxides are precipitated in an Ag matrix (to be described later) is attracting much attention.

There is the internally oxidized silver-oxide material which is made by subjecting an Ag alloy having a composition consisting essentially of, by weight (percentages are by weight), 4.5 to 10% Sn, 0.1 to 5% In, and 0.01 to 5% Bi, with the balance being Ag and unavoidable impurities, to an internal oxidation treatment under the conditions of maintaining at a temperature ranging from 650 to 750° C. in an oxidizing atmosphere for 15 to 30 hours, as disclosed in U.S. Pat. No. 4,680,162.

There is also the internally oxidized silver-oxide material which is made by subjecting an Ag alloy having a composition consisting essentially of, by weight (percentages are by weight), 5 to 10% Sn, 1 to 6% In, and 0.01 to 0.5% Ni, with the balance being Ag and unavoidable impurities, to an internal oxidation treatment under the conditions of maintaining at a temperature ranging from 650 to 750° C. in an oxidizing atmosphere for 15 to 30 hours, as disclosed in Japanese Patent Application, Second Publication No. S55-4825.

There is also the internally oxidized silver-oxide material which is made by subjecting an Ag alloy having a composition consisting essentially of, by weight (percentages are by weight), 3 to 12% Sn, 2 to 15% In, and 0.1 to 8% Cu, with the balance being Ag and unavoidable impurities, to an internal oxidation treatment under the conditions of maintaining at a temperature ranging from 650 to 750° C. in an oxidizing atmosphere for 15 to 30 hours, as disclosed in Japanese Patent Application, First Publication No. S51-55989.

There is also the internally oxidized silver-oxide material which is made by subjecting an Ag alloy having a composition consisting essentially of, by weight % (percentages are by weight), 4 to 11% Sn, 1 to 5% In, and 0.05 to 4% Te, and, if necessary, 0.03 to 0.5% Ni, with the balance being Ag and unavoidable impurities, to an internal oxidation treatment under the conditions of maintaining at a temperature ranging from 650 to 750° C. in an oxidizing atmosphere for 15 to 30 hours, as disclosed in Japanese Patent Application, First Publication No. H04-314837.

The electrical contact including the internally oxidized silver-oxide material described above for the use in electromagnetic relay, however, has relatively low electrical conductivity. Thus, when the electrical contact is including the internally oxidized silver-oxide material in a small size, greater heat generation occurs between the contacts, and which leads to softening of the contacts. As a result, the contacts have significantly deteriorated welding resistance and wear resistance, eventually reaching the end of their service life in a relatively short period of time.

SUMMARY OF THE INVENTION

Under these circumstances, the present inventors have intensively studied to improve the electrical conductivity of the conventional electrical contacts described above, and the have obtained the following findings.

A first aspect of the present invention was completed upon the results of the study described below.

After specifying the contents of Sn to 5.1 to 9%, In to 1.5 to 5%, and Bi to 0.005 to 0.06% for the alloy components common to the Ag alloy of the internally oxidized silver-oxide material, which constitutes the conventional electrical contacts disclosed in the above-mentioned U.S. Pat. No. 4,680,162, in the state before subjecting to the internal oxidation treatment, the resulting material is subjected to the internal oxidation treatment under the ordinary conditions described above. When the material is then subjected to a heat treatment at a temperature ranging from 900 to 960° C. in an air atmosphere for 10 to 20 hours, ultra-fine grains of Sn-based oxides and In-based oxides precipitated through the internal oxidation treatment diffuse, aggregate, and grow into coarse grains of composite oxides by the action of Bi contained as an alloy component, thus yielding an internally oxidized silver-oxide material having a metallographic structure such that the coarse grains of composite oxides are dispersed in the Ag matrix. In the internally oxidized silver-oxide material thus obtained, the ultra-fine grains of Sn-based oxides and In-based oxides precipitated by the internal oxidation treatment do not exist in the Ag matrix, and therefore electrical conductivity of the electrical contact is remarkably improved and the increase in heat generation due to high current density brought about by the size reduction can be significantly reduced. As a result, fusing between the contacts and wear in the electrical contacts including the internally oxidized silver-oxide material are suppressed, thus exhibiting excellent contact characteristics over an extended period of time.

The electrical contact having high electrical conductivity for a compact electromagnetic relay according to the first aspect of the present invention is based on the results of the study described above.

The electrical contact having high electrical conductivity for a compact electromagnetic relay according to the first aspect of the present invention is including the internally oxidized silver-oxide material. The internally oxidized silver-oxide material is prepared by subjecting an Ag alloy having a composition consisting essentially of, by weight, 5.1 to 9% Sn, 1.5 to 5% In, and 0.005 to 0.06% Bi, with the balance being of Ag and unavoidable impurities, to an internal oxidation treatment and then subjecting to a heat treatment for diffusion, aggregation, and growth of precipitated oxides. The internally oxidized silver-oxide material has a metallographic structure such that coarse grains of composite oxides are dispersed and distributed in an Ag matrix, the coarse grains of composite oxides being formed as a result of coarsening of ultra-fine grains of Sn-based oxides and ultra-fine grains of In-based oxides, which are precipitated by the internal oxidation treatment, by the heat treatment for diffusion, aggregation, and growth of the precipitated oxides.

Since the electrical contact according to the first aspect of the present invention has high electrical conductivity, heat generation due to high current density brought about by the size reduction can be significantly reduced. As a result, softening of the electrical contact by the heating thereof is suppressed and durability against fusing of the contacts can be maintained. Thus, electrical contact characteristics such as welding resistance and wear resistance can be maintained at high levels over an extended period of time.

The reason will now be described below for specifying the composition described above for the Ag alloy used to make the electrical contact according to the first aspect of the present invention.

(a) Sn

Sn makes thermally stable Sn-based oxides through an internal oxidation treatment, and therefore a Sn component has the effect of forming the thermally stable Sn-based oxides through the internal oxidation treatment and improving welding resistance and wear resistance of the contacts.

When the Sn content is less than 5.1%, an insufficient amount of Sn-based oxides precipitates, and therefore the improvement effects described above may not be achieved. When the Sn content is more than 9%, wire drawability and header workability may be deteriorated by a significant increase in hardness. Therefore, the Sn content is set in a range from 5.1 to 9%.

(b) In

In has an effect of accelerating the precipitation of Sn-based oxides in the internal oxidation treatment, and forms thermally stable In-based oxides. Thus, in the presence of Sn-based oxides, In has the effects of improving the welding resistance.

When the In content is less than 1.5%, a sufficient amount of Sn-based oxides cannot be precipitated and Sn component may form a solid solution as an alloy component in the Ag matrix, resulting in difficulty in maintaining high electrical conductivity. When the In content is more than 5%, wire drawability and header workability may be deteriorated by an increase in hardness. Therefore, the In content is set in a range from 1.5 to 5%.

(c) Bi

Bi has an effect of significantly accelerating the diffusion, aggregation, and growth of the ultra-fine grains of Sn-based oxides and In-based oxides precipitated through internal oxidation treatment, which result in the formation of coarse grains of composite oxides, during the heat treatment for diffusion, aggregation, and growth of the precipitated oxides.

When the Bi content is less than 0.005%, diffusion, aggregation, and growth of the ultra-fine grains of Sn-based oxides and In-based oxides do not proceed sufficiently, resulting in the ultra-fine grains of Sn-based oxides and In-based oxides remaining in the Ag matrix that may make it impossible to achieve sufficient improvement in the electrical conductivity. When the Bi content is more than 0.06%, the coarse grains of composite oxides grow too large, resulting in excessively large proportion of area occupied by the Ag matrix that causes welding resistance to decrease. Therefore, the Bi content is set in a range from 0.005 to 0.06%.

A second aspect of the present invention was completed upon the results of the study described below.

After specifying the contents of Sn to 5.1 to 9%, In to 1.5 to 5%, and Ni to 0.03 to 0.5% for the alloy components common to the Ag alloy of the internally oxidized silver-oxide material, which constitutes the conventional electrical contacts disclosed in the above-mentioned Japanese Patent Application, Second Publication No. S55-4825, in the state before subjecting to the internal oxidation treatment, and further adding 0.005 to 0.06% Bi as an alloy component, the resulting Bi-containing Ag alloy is subjected to the internal oxidation treatment under the ordinary conditions described above. When the material is then subjected to a heat treatment at a temperature ranging from 900 to 960° C. in an air atmosphere for 10 to 20 hours, ultra-fine grains of Sn-based oxides and In-based oxides precipitated through the internal oxidation treatment diffuse, aggregate, and grow into coarse grains of composite oxides by the action of Bi contained as an alloy component, thus yielding an internally oxidized silver-oxide material having a metallographic structure such that the coarse grains of composite oxides are dispersed in the Ag matrix. In the internally oxidized silver-oxide material thus obtained, the ultra-fine grains of Sn-based oxides and In-based oxides precipitated by the internal oxidation treatment do not exist in the Ag matrix, and therefore electrical conductivity of the electrical contact is remarkably improved and the increase in heat generation due to high current density brought about by the size reduction can be significantly reduced. As a result, fusing between the contacts and wear in the electrical contacts including the internally oxidized silver-oxide material are suppressed, thus exhibiting excellent contact characteristics over an extended period of time.

The electrical contact having high electrical conductivity for a compact electromagnetic relay according to the second aspect of the present invention is based on the results of the study described above.

The electrical contact according to the second aspect of the present invention is including an internally oxidized silver-oxide material. The internally oxidized silver-oxide material is prepared by subjecting an Ag alloy having a composition consisting essentially of, by weight, 5.1 to 9% Sn, 1.5 to 5% In, 0.03 to 0.5% Ni, and 0.005 to 0.06% Bi, with the balance being Ag and unavoidable impurities, to an internal oxidation treatment and then subjecting to a heat treatment for diffusion, aggregation, and growth of precipitated oxides. The internally oxidized silver-oxide material has a metallographic structure such that coarse grains of composite oxides are dispersed and distributed in an Ag matrix, the coarse grains of composite oxides being formed as a result of coarsening of ultra-fine grains of Sn-based oxides and ultra-fine grains of In-based oxides, which are precipitated by the internal oxidation treatment, by the heat treatment for diffusion, aggregation, and growth of the precipitated oxides.

Since the electrical contact according to the second aspect of the present invention has high electrical conductivity, heat generation due to high current density brought about by the size reduction can be significantly reduced. As a result, softening of the electrical contact by the heating thereof is suppressed and durability against fusing of the contacts can be maintained. Thus, electrical contact characteristics such as welding resistance and wear resistance can be maintained at high levels over an extended period of time.

The reason will now be described below for specifying the composition described above for the Ag alloy used to make the electrical contact according to the second aspect of the present invention.

(a) Sn

Sn makes thermally stable Sn-based oxides through an internal oxidation treatment, and therefore a Sn component has the effect of forming the thermally stable Sn-based oxides through the internal oxidation treatment and improving welding resistance and wear resistance of the contacts.

When the Sn content is less than 5.1%, an insufficient amount of Sn-based oxides precipitates, and therefore the improvement effects described above may not be achieved. When the Sn content is more than 9%, wire drawability and header workability may be deteriorated by a significant increase in hardness. Therefore, the Sn content is set in a range from 5.1 to 9%.

(b) In

In has an effect of accelerating the precipitation of Sn-based oxides in the internal oxidation treatment, and forms thermally stable In-based oxides. Thus, in the presence of Sn-based oxides, In has the effects of improving the welding resistance.

When the In content is less than 1.5%, a sufficient amount of Sn-based oxides cannot be precipitated and Sn component may form a solid solution as an alloy component in the Ag matrix, resulting in difficulty in maintaining high electrical conductivity. When the In content is more than 5%, wire drawability and header workability may be deteriorated by an increase in hardness. Therefore, the In content is set in a range from 1.5 to 5%.

(c) Ni

Ni has an effect of refining Ag crystal grains of the Ag matrix to improve the strength, thereby making it possible to further reduce the thickness of the electrical contact.

When the Ni content is less than 0.03%, a desired effect of improving the strength may not be obtained. When the Ni content is more than 0.5%, wire drawability and header workability tend to deteriorate. Therefore, the Ni content is set in a range from 0.03 to 0.5%.

(d) Bi

Bi has an effect of significantly accelerating the diffusion, aggregation, and growth of the ultra-fine grains of Sn-based oxides and In-based oxides precipitated through internal oxidation treatment, which result in the formation of coarse grains of composite oxides, during the heat treatment for diffusion, aggregation, and growth of the precipitated oxides.

When the Bi content is less than 0.005%, diffusion, aggregation, and growth of the ultra-fine grains of Sn-based oxides and In-based oxides do not proceed sufficiently, resulting in the ultra-fine grains of Sn-based oxides and In-based oxides remaining in the Ag matrix that may make it impossible to achieve sufficient improvement in the electrical conductivity. When the Bi content is more than 0.06%, the coarse grains of composite oxides grow too large, resulting in excessively large proportion of area occupied by the Ag matrix that causes welding resistance to decrease. Therefore, the Bi content is set in a range from 0.005 to 0.06%.

A third aspect of the present invention was completed upon the results of the study described below.

After specifying the contents of Sn to 5.1 to 9%, In to 1.5 to 5%, and Cu to 0.05 to 0.5% for the alloy components common to the Ag alloy of the internally oxidized silver-oxide material, which constitutes the conventional electrical contacts disclosed in the above-mentioned Japanese Patent Application, First Publication No. S51-55989, in the state before subjecting to the internal oxidation treatment, and optionally adding 0.03 to 0.5% Ni, and further adding 0.005 to 0.06% Bi as an alloy component, the resulting Bi-containing Ag alloy is subjected to the internal oxidation treatment under the ordinary conditions described above. When the material is then subjected to a heat treatment at a temperature ranging from 900 to 960° C. in an air atmosphere for 10 to 20 hours, ultra-fine grains of Sn-based oxides and In-based oxides precipitated through the internal oxidation treatment diffuse, aggregate, and grow into coarse grains of composite oxides by the action of Bi contained as an alloy component, thus yielding an internally oxidized silver-oxide material having a metallographic structure such that the coarse grains of composite oxides are dispersed in the Ag matrix. In the internally oxidized silver-oxide material thus obtained, the ultra-fine grains of Sn-based oxides and In-based oxides precipitated by the internal oxidation treatment do not exist in the Ag matrix, and therefore electrical conductivity of the electrical contact is remarkably improved and the increase in heat generation due to high current density brought about by the size reduction can be significantly reduced. As a result, fusing between the contacts and wear in the electrical contacts including the internally oxidized silver-oxide material are suppressed, thus exhibiting excellent contact characteristics over an extended period of time. In the case of further adding Ni, the strength is improved by the action of Ni, which contributes to size reduction of the electrical contact.

The electrical contact according to the third aspect of the present invention is based on the results of the study described above.

The electrical contact having high electrical conductivity for a compact electromagnetic relay according to one mode of the third aspect of the present invention is including the internally oxidized silver-oxide material. The internally oxidized silver-oxide material is prepared by subjecting an Ag alloy having a composition consisting essentially of, by weight, 5.1 to 9% Sn, 1.5 to 5% In, 0.05 to 0.5% Cu, and 0.005 to 0.06% Bi, with the balance being of Ag and unavoidable impurities, to an internal oxidation treatment and then subjecting to a heat treatment for diffusion, aggregation, and growth of precipitated oxides. The internally oxidized silver-oxide material has a metallographic structure such that coarse grains of composite oxides are dispersed and distributed in an Ag matrix, the coarse grains of composite oxides being formed as a result of coarsening of ultra-fine grains of Sn-based oxides and ultra-fine grains of In-based oxides, which are precipitated by the internal oxidation treatment, by the heat treatment for diffusion, aggregation, and growth of the precipitated oxides.

Since the electrical contact according to one mode of the third aspect of the present invention has high electrical conductivity, heat generation due to high current density brought about by the size reduction can be significantly reduced. As a result, softening of the electrical contact by the heating thereof is suppressed and durability against fusing of the contacts can be maintained. Thus, electrical contact characteristics such as welding resistance and wear resistance can be maintained at high levels over an extended period of time.

The electrical contact having high electrical conductivity for a compact electromagnetic relay according to another mode of the third aspect of the present invention is including the internally oxidized silver-oxide. The internally oxidized silver-oxide material is prepared by subjecting an Ag alloy having a composition consisting essentially of, by weight, 5.1 to 9% Sn, 1.5 to 5% In, 0.05 to 0.5% Cu, 0.005 to 0.06% Bi, and 0.03 to 0.5% Ni, with the balance being Ag and unavoidable impurities, to an internal oxidation treatment and then subjecting to a heat treatment for diffusion, aggregation, and growth of precipitated oxides. The internally oxidized silver-oxide material has a metallographic structure such that coarse grains of composite oxides are dispersed and distributed in an Ag matrix, the coarse grains of composite oxides being formed as a result of coarsening of ultra-fine grains of Sn-based oxides and ultra-fine grains of In-based oxides, which are precipitated by the internal oxidation treatment, by the heat treatment for diffusion, aggregation, and growth of the precipitated oxides.

Since the electrical contact according to another mode of the third aspect of the present invention has high electrical conductivity, heat generation due to high current density brought about by the size reduction can be significantly reduced. As a result, softening of the electrical contact by the heating thereof is suppressed and durability against fusing of the contacts can be maintained. Thus, electrical contact characteristics such as welding resistance and wear resistance can be maintained at high levels over an extended period of time.

By the addition of Ni, Ag crystal grains of the Ag matrix are refined and the strength is improved, thus making it possible to further reduce the thickness of the electrical contact.

The reason will now be described below for specifying the composition described above for the Ag alloy used to make the electrical contact according to the third aspect of the present invention.

(a) Sn

Sn makes thermally stable Sn-based oxides through an internal oxidation treatment, and therefore a Sn component has the effect of forming the thermally stable Sn-based oxides through the internal oxidation treatment and improving welding resistance and wear resistance of the contacts.

When the Sn content is less than 5.1%, an insufficient amount of Sn-based oxides precipitates, and therefore the improvement effects described above may not be achieved. When the Sn content is more than 9%, wire drawability and header workability may be deteriorated by a significant increase in hardness. Therefore, the Sn content is set in a range from 5.1 to 9%.

(b) In

In has an effect of accelerating the precipitation of Sn-based oxides in the internal oxidation treatment, and forms thermally stable In-based oxides. Thus, in the presence of Sn-based oxides, In has the effects of improving the welding resistance.

When the In content is less than 1.5%, a sufficient amount of Sn-based oxides cannot be precipitated and Sn component may form a solid solution as an alloy component in the Ag matrix, resulting in difficulty in maintaining high electrical conductivity. When the In content is more than 5%, wire drawability and header workability may be deteriorated by an increase in hardness. Therefore, the In content is set in a range from 1.5 to 5%.

(c) Cu

Cu has an effect of accelerating the precipitation of Sn-based oxides and In-based oxides in the internal oxidation treatment.

When the Cu content is less than 0.05%, the improvement effects described above may not be achieved. When the Cu content is more than 0.5%, welding resistance and wear resistance tend to deteriorate. Therefore, the Cu content is set in a range from 0.05 to 0.5%.

(d) Bi

Bi has an effect of significantly accelerating the diffusion, aggregation, and growth of the ultra-fine grains of Sn-based oxides and In-based oxides precipitated through internal oxidation treatment, which result in the formation of coarse grains of composite oxides, during the heat treatment for diffusion, aggregation, and growth of the precipitated oxides.

When the Bi content is less than 0.005%, diffusion, aggregation, and growth of the ultra-fine grains of Sn-based oxides and In-based oxides do not proceed sufficiently, resulting in the ultra-fine grains of Sn-based oxides and In-based oxides remaining in the Ag matrix that may make it impossible to achieve sufficient improvement in the electrical conductivity. When the Bi content is more than 0.06%, the coarse grains of composite oxides grow too large, resulting in excessively large proportion of area occupied by the Ag matrix that causes welding resistance to decrease. Therefore, the Bi content is set in a range from 0.005 to 0.06%.

(e) Ni

Ni has an effect of refining Ag crystal grains of the Ag matrix to improve the strength, thereby making it possible to further reduce the thickness of the electrical contact. Therefore, Ni is optionally added.

When the Ni content is less than 0.03%, a desired effect of improving the strength may not be obtained. When the Ni content is more than 0.5%, wire drawability and header workability tend to deteriorate. Therefore, the Ni content is set in a range from 0.03 to 0.5%.

A fourth aspect of the present invention was completed upon the results of the study described below.

After specifying the contents of Sn to 5.1 to 9%, In to 1.5 to 5%, and Te to 0.05 to 0.8% for the alloy components common to the Te-containing Ag alloy of the internally oxidized silver-oxide material, which constitutes the conventional electrical contacts disclosed in the above-mentioned Japanese Patent Application, First Publication No. H04-314837, in the state before subjecting to the internal oxidation treatment, and optionally specifying the content of Ni to 0.03 to 0.5%, the resulting Ag alloy is subjected to the internal oxidation treatment under the ordinary conditions described above. When the material is then subjected to a heat treatment at a temperature ranging from 900 to 960° C. in an air atmosphere for 10 to 20 hours, ultra-fine grains of Sn-based oxides and In-based oxides precipitated through the internal oxidation treatment diffuse, aggregate, and grow into coarse grains of composite oxides by the action of Te contained as an alloy component, thus yielding an internally oxidized silver-oxide material having a metallographic structure such that the coarse grains of composite oxides are dispersed in the Ag matrix. In the internally oxidized silver-oxide material thus obtained, the ultra-fine grains of Sn-based oxides and In-based oxides precipitated by the internal oxidation treatment do not exist in the Ag matrix, and therefore electrical conductivity of the electrical contact is remarkably improved and the increase in heat generation due to high current density brought about by the size reduction can be significantly reduced. As a result, fusing between the contacts and wear in the electrical contacts including the internally oxidized silver-oxide material are suppressed, thus exhibiting excellent contact characteristics over an extended period of time. In the case of further adding Ni, the strength is improved by the action of Ni, which contributes to size reduction of the electrical contact.

The electrical contact according to the fourth aspect of the present invention is based on the results of the study described above.

The electrical contact having high electrical conductivity for a compact electromagnetic relay according to one mode of the fourth aspect of the present invention is including the internally oxidized silver-oxide material. The internally oxidized silver-oxide material is prepared by subjecting an Ag alloy having a composition consisting essentially of, by weight, 5.1 to 9% Sn, 1.5 to 5% In, and 0.05 to 0.8% Te, with the balance being Ag and unavoidable impurities, to an internal oxidation treatment and then subjecting to a heat treatment for diffusion, aggregation, and growth of precipitated oxides. The internally oxidized silver-oxide material has a metallographic structure such that coarse grains of composite oxides are dispersed and distributed in an Ag matrix, the coarse grains of composite oxides being formed as a result of coarsening of ultra-fine grains of Sn-based oxides and ultra-fine grains of In-based oxides, which are precipitated by the internal oxidation treatment, by the heat treatment for diffusion, aggregation, and growth of the precipitated oxides.

Since the electrical contact according to one mode of the fourth aspect of the present invention has high electrical conductivity, heat generation due to high current density brought about by the size reduction can be significantly reduced. As a result, softening of the electrical contact by the heating thereof is suppressed and durability against fusing of the contacts can be maintained. Thus, electrical contact characteristics such as welding resistance and wear resistance can be maintained at high levels over an extended period of time.

The electrical contact having high electrical conductivity for a compact electromagnetic relay according to another mode of the fourth aspect of the present invention is including the internally oxidized silver-oxide. The internally oxidized silver-oxide material is prepared by subjecting an Ag alloy having a composition consisting essentially of, by weight, 5.1 to 9% Sn, 1.5 to 5% In, 0.05 to 0.8% Te, and 0.03 to 0.5% Ni, with the balance being Ag and unavoidable impurities, to an internal oxidation treatment and then subjecting to a heat treatment for diffusion, aggregation, and growth of precipitated oxides. The internally oxidized silver-oxide material has a metallographic structure such that coarse grains of composite oxides are dispersed and distributed in an Ag matrix, the coarse grains of composite oxides being formed as a result of coarsening of ultra-fine grains of Sn-based oxides and ultra-fine grains of In-based oxides, which are precipitated by the internal oxidation treatment, by the heat treatment for diffusion, aggregation, and growth of the precipitated oxides.

Since the electrical contact according to another mode of the fourth aspect of the present invention has high electrical conductivity, heat generation due to high current density brought about by the size reduction can be significantly reduced. As a result, softening of the electrical contact by the heating thereof is suppressed and durability against fusing of the contacts can be maintained. Thus, electrical contact characteristics such as welding resistance and wear resistance can be maintained at high levels over an extended period of time.

By the addition of Ni, Ag crystal grains of the Ag matrix are refined and the strength is improved, thus making it possible to further reduce the thickness of the electrical contact.

The reason will now be described below for specifying the composition described above for the Ag alloy used to make the electrical contact according to the fourth aspect of the present invention.

(a) Sn

Sn makes thermally stable Sn-based oxides through an internal oxidation treatment, and therefore a Sn component has the effect of forming the thermally stable Sn-based oxides through the internal oxidation treatment and improving welding resistance and wear resistance of the contacts.

When the Sn content is less than 5.1%, an insufficient amount of Sn-based oxides precipitates, and therefore the improvement effects described above may not be achieved. When the Sn content is more than 9%, wire drawability and header workability may be deteriorated by a significant increase in hardness. Therefore, the Sn content is set in a range from 5.1 to 9%.

(b) In

In has an effect of accelerating the precipitation of Sn-based oxides in the internal oxidation treatment, and forms thermally stable In-based oxides. Thus, in the presence of Sn-based oxides, In has the effects of improving the welding resistance.

When the In content is less than 1.5%, a sufficient amount of Sn-based oxides cannot be precipitated and Sn component may form a solid solution as an alloy component in the Ag matrix, resulting in difficulty in maintaining high electrical conductivity. When the In content is more than 5%, wire drawability and header workability may be deteriorated by an increase in hardness. Therefore, the In content is set in a range from 1.5 to 5%.

(c) Te

Te has an effect of forming oxides capable of easily subliming upon arc generation caused by on-off operation to improve welding resistance and wear resistance. Te also has an effect of significantly accelerating the diffusion, aggregation, and growth of the ultra-fine grains of Sn-based oxides and In-based oxides precipitated through internal oxidation treatment, which result in the formation of coarse grains of composite oxides, during the heat treatment for diffusion, aggregation, and growth of the precipitated oxides.

When the Te content is less than 0.05%, diffusion, aggregation, and growth of the ultra-fine grains of Sn-based oxides and In-based oxides do not proceed sufficiently, resulting in the ultra-fine grains of Sn-based oxides and In-based oxides remaining in the Ag matrix that may make it impossible to achieve sufficient improvement in the electrical conductivity. When the Te content is more than 0.8%, the coarse grains of composite oxides grow too large, resulting in excessively large proportion of area occupied by the Ag matrix that causes welding resistance to decrease, and also workability tends to deteriorate. Therefore, the Te content is set in a range from 0.05 to 0.8%.

(d) Ni

Ni has an effect of refining Ag crystal grains of the Ag matrix to improve the strength, thereby making it possible to further reduce the thickness of the electrical contact. Therefore, Ni is optionally added.

When the Ni content is less than 0.03%, a desired effect of improving the strength may not be obtained. When the Ni content is more than 0.5%, wire drawability and header workability tend to deteriorate. Therefore, the Ni content is set in a range from 0.03 to 0.5%.

A fifth aspect of the present invention was completed upon the results of the study described below.

After specifying the contents of Sn to 5.1 to 9%, In to 1.5 to 5%, and Cu to 0.05 to 0.5% for the alloy components common to the Ag alloy of the internally oxidized silver-oxide material, which constitutes the conventional electrical contacts disclosed in the above-mentioned Japanese Patent Application, First Publication No. S51-55989, in the state before subjecting to the internal oxidation treatment, and optionally adding 0.03 to 0.5% Ni, and further adding 0.05 to 0.8% Te as an alloy component, the resulting Te-containing Ag alloy is subjected to the internal oxidation treatment under the ordinary conditions described above. When the material is then subjected to a heat treatment at a temperature ranging from 900 to 960° C. in an air atmosphere for 10 to 20 hours, ultra-fine grains of Sn-based oxides and In-based oxides precipitated through the internal oxidation treatment diffuse, aggregate, and grow into coarse grains of composite oxides by the action of Te contained as an alloy component, thus yielding an internally oxidized silver-oxide material having a metallographic structure such that the coarse grains of composite oxides are dispersed in the Ag matrix. In the internally oxidized silver-oxide material thus obtained, the ultra-fine grains of Sn-based oxides and In-based oxides precipitated by the internal oxidation treatment do not exist in the Ag matrix, and therefore electrical conductivity of the electrical contact is remarkably improved and the increase in heat generation due to high current density brought about by the size reduction can be significantly reduced. As a result, fusing between the contacts and wear in the electrical contacts including the internally oxidized silver-oxide material are suppressed, thus exhibiting excellent contact characteristics over an extended period of time. In the case of further adding Ni, the strength is improved by the action of Ni, which contributes to size reduction of the electrical contact.

The electrical contact according to the fifth aspect of the present invention is based on the results of the study described above.

The electrical contact having high electrical conductivity for a compact electromagnetic relay according to one mode of the fifth aspect of the present invention is including the internally oxidized silver-oxide. The internally oxidized silver-oxide material is prepared by subjecting an Ag alloy having a composition consisting essentially of, by weight, 5.1 to 9% Sn, 1.5 to 5% In, 0.05 to 0.5% Cu, and 0.05 to 0.8% Te, with the balance being Ag and unavoidable impurities, to an internal oxidation treatment and then subjecting to a heat treatment for diffusion, aggregation, and growth of precipitated oxides. The internally oxidized silver-oxide material has a metallographic structure such that coarse grains of composite oxides are dispersed and distributed in an Ag matrix, the coarse grains of composite oxides being formed as a result of coarsening of ultra-fine grains of Sn-based oxides and ultra-fine grains of In-based oxides, which are precipitated by the internal oxidation treatment, by the heat treatment for diffusion, aggregation, and growth of the precipitated oxides.

Since the electrical contact according to one mode of the fifth aspect of the present invention has high electrical conductivity, heat generation due to high current density brought about by the size reduction can be significantly reduced. As a result, softening of the electrical contact by the heating thereof is suppressed and durability against fusing of the contacts can be maintained. Thus, electrical contact characteristics such as welding resistance and wear resistance can be maintained at high levels over an extended period of time.

The electrical contact having high electrical conductivity for a compact electromagnetic relay according to another mode of the fifth aspect of the present invention is including the internally oxidized silver-oxide material. The internally oxidized silver-oxide material is prepared by subjecting an Ag alloy having a composition consisting essentially of, by weight, 5.1 to 9% Sn, 1.5 to 5% In, 0.05 to 0.5% Cu, 0.05 to 0.8% Te, and 0.03 to 0.5% Ni, with the balance being Ag and unavoidable impurities, to an internal oxidation treatment and then subjecting to a heat treatment for diffusion, aggregation, and growth of precipitated oxides. The internally oxidized silver-oxide material has a metallographic structure such that coarse grains of composite oxides are dispersed and distributed in an Ag matrix, the coarse grains of composite oxides being formed as a result of coarsening of ultra-fine grains of Sn-based oxides and ultra-fine grains of In-based oxides, which are precipitated by the internal oxidation treatment, by the heat treatment for diffusion, aggregation, and growth of the precipitated oxides.

Since the electrical contact according to another mode of the fifth aspect of the present invention has high electrical conductivity, heat generation due to high current density brought about by the size reduction can be significantly reduced. As a result, softening of the electrical contact by the heating thereof is suppressed and durability against fusing of the contacts can be maintained. Thus, electrical contact characteristics such as welding resistance and wear resistance can be maintained at high levels over an extended period of time.

By the addition of Ni, Ag crystal grains of the Ag matrix are refined and the strength is improved, thus making it possible to further reduce the thickness of the electrical contact.

The reason will now be described below for specifying the composition described above for the Ag alloy used to make the electrical contact according to the fifth aspect of the present invention.

(a) Sn

Sn makes thermally stable Sn-based oxides through an internal oxidation treatment, and therefore a Sn component has the effect of forming the thermally stable Sn-based oxides through the internal oxidation treatment and improving welding resistance and wear resistance of the contacts.

When the Sn content is less than 5.1%, an insufficient amount of Sn-based oxides precipitates, and therefore the improvement effects described above may not be achieved. When the Sn content is more than 9%, wire drawability and header workability may be deteriorated by a significant increase in hardness. Therefore, the Sn content is set in a range from 5.1 to 9%.

(b) In

In has an effect of accelerating the precipitation of Sn-based oxides in the internal oxidation treatment, and forms thermally stable In-based oxides. Thus, in the presence of Sn-based oxides, In has the effects of improving the welding resistance.

When the In content is less than 1.5%, a sufficient amount of Sn-based oxides cannot be precipitated and Sn component may form a solid solution as an alloy component in the Ag matrix, resulting in difficulty in maintaining high electrical conductivity. When the In content is more than 5%, wire drawability and header workability may be deteriorated by an increase in hardness. Therefore, the In content is set in a range from 1.5 to 5%.

(c) Cu

Cu has an effect of accelerating the precipitation of Sn-based oxides and In-based oxides in the internal oxidation treatment.

When the Cu content is less than 0.05%, the improvement effects described above may not be achieved. When the Cu content is more than 0.5%, welding resistance and wear resistance tend to deteriorate. Therefore, the Cu content is set in a range from 0.05 to 0.5%.

(d) Te

Te has an effect of forming oxides capable of easily subliming upon arc generation caused by on-off operation to improve welding resistance and wear resistance. Te also has an effect of significantly accelerating the diffusion, aggregation, and growth of the ultra-fine grains of Sn-based oxides and In-based oxides precipitated through internal oxidation treatment, which result in the formation of coarse grains of composite oxides, during the heat treatment for diffusion, aggregation, and growth of the precipitated oxides.

When the Te content is less than 0.05%, diffusion, aggregation, and growth of the ultra-fine grains of Sn-based oxides and In-based oxides do not proceed sufficiently, resulting in the ultra-fine grains of Sn-based oxides and In-based oxides remaining in the Ag matrix that may make it impossible to achieve sufficient improvement in the electrical conductivity. When the Te content is more than 0.8%, the coarse grains of composite oxides grow too large, resulting in excessively large proportion of area occupied by the Ag matrix that causes welding resistance to decrease, and also workability tends to deteriorate. Therefore, the Te content is set in a range from 0.05 to 0.8%.

(e) Ni

Ni has an effect of refining Ag crystal grains of the Ag matrix to improve the strength, thereby making it possible to further reduce the thickness of the electrical contact. Therefore, Ni is optionally added.

When the Ni content is less than 0.03%, a desired effect of improving the strength may not be obtained. When the Ni content is more than 0.5%, wire drawability and header workability tend to deteriorate. Therefore, the Ni content is set in a range from 0.03 to 0.5%.

PREFERRED EMBODIMENTS

Figure 1:
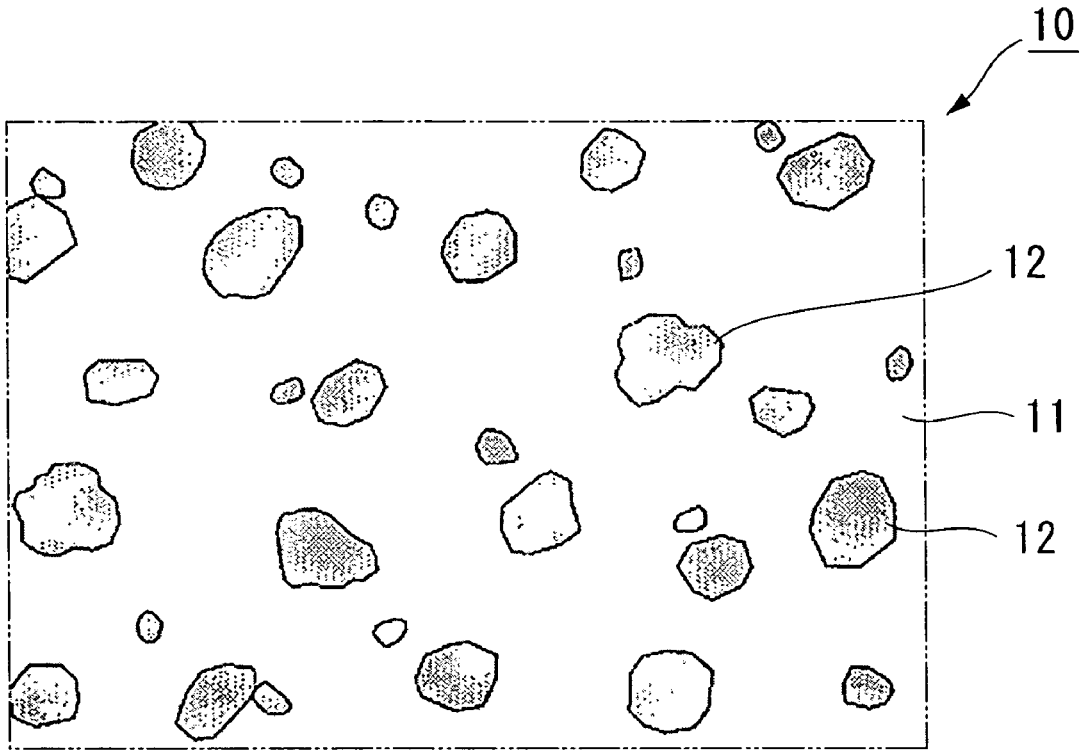
FIG. 1 is a schematic view showing a metallographic structure (magnification: 20,000 times) of an electrical contact of Embodiment 1-3 according to the first aspect of the present invention.

Preferred embodiments of the present invention will be described in detail with reference to the accompanying drawings. The present invention is not limited to the following respective embodiments and constituent features of these embodiments may be appropriately combined.

(First Aspect)

Each of Ag alloys having the composition shown in Table 1-1 was melted by a high frequency induction melting furnace and then casted into a columnar ingot. The ingot was heat-extruded at a temperature of 700° C. to form a plate 30 mm in width×10 mm in thickness, which was hot-rolled at a temperature of 700° C. to form a plate 30 mm in width×3 mm in thickness, and then the plate was cold-rolled while subjecting to intermediate annealing to form a thin plate 30 mm in width×0.6 mm in thickness. The resulting thin plate was cut along the longitudinal direction at intervals of 2 mm in width to form a strip 30 mm in length×2 mm in width×0.6 mm in thickness.

The strip was subjected to an internal oxidation treatment under the conditions of maintaining at 700° C. in an oxygen atmosphere for 24 hours to obtain internally oxidized Ag alloys (hereinafter referred to as internally oxidized materials) 1-A1 to 1-A13 and internally oxidized materials 1-B1 to 1-B9 of comparative embodiments.

TABLE 1-1

| Internally oxidized | Components of Ag alloy (% by weight) | | | |
|---|---|---|---|---|
| material | Sn | In | Bi | Ag + Impurities |
| 1-A1 | 5.13 | 3.15 | 0.033 | Balance |
| 1-A2 | 6.04 | 3.08 | 0.031 | Balance |
| 1-A3 | 7.02 | 3.13 | 0.030 | Balance |
| 1-A4 | 8.01 | 3.22 | 0.032 | Balance |
| 1-A5 | 8.96 | 3.17 | 0.031 | Balance |
| 1-A6 | 6.97 | 1.52 | 0.030 | Balance |
| 1-A7 | 7.99 | 2.14 | 0.030 | Balance |
| 1-A8 | 7.06 | 3.96 | 0.029 | Balance |
| 1-A9 | 7.05 | 4.97 | 0.033 | Balance |
| 1-A10 | 7.03 | 3.09 | 0.0054 | Balance |
| 1-A11 | 6.89 | 3.17 | 0.014 | Balance |
| 1-A12 | 7.08 | 3.06 | 0.043 | Balance |
| 1-A13 | 7.03 | 3.21 | 0.058 | Balance |
| 1-B1 | 5.13 | 3.15 | — | Balance |
| 1-B2 | 5.99 | 3.12 | — | Balance |
| 1-B3 | 7.05 | 3.06 | — | Balance |
| 1-B4 | 8.00 | 3.21 | — | Balance |
| 1-B5 | 8.95 | 3.05 | — | Balance |
| 1-B6 | 7.01 | 1.54 | — | Balance |
| 1-B7 | 6.96 | 2.18 | — | Balance |
| 1-B8 | 7.02 | 4.05 | — | Balance |
| 1-B9 | 7.04 | 4.97 | — | Balance |

Each of the strip-shaped internally oxidized materials 1-A1 to 1-A13 and the internally oxidized materials 1-B1 to 1-B9 of the comparative embodiments was put in a die and then compressed to form a columnar formed article 70 mm in diameter×70 mm in length.

The columnar formed article was subjected to a heat treatment for diffusion, aggregation, and growth of precipitated oxides under the conditions of maintaining at predetermined temperature ranging from 900 to 950° C. in an air atmosphere for 12 hours.

The heat-treated columnar formed article was hot-extruded at a temperature of 800° C. to form a wire rod of 7 mm in diameter, which was then hot-drawn at a temperature of 800° C. to form a wire rod of 1.4 mm in diameter.

Using a header machine, rivet-shaped electrical contacts 2.3 mm in head diameter×0.3 mm in head thickness×1.5 mm in leg diameter×1.5 mm in leg length according to the first aspect of the present invention (Embodiments 1-1 to 1-13) and electrical contacts containing no Bi as an alloy component (Comparative Embodiments 1-1 to 1-9) were produced from the wire rods.

Under the same conditions as described above, except that the internally oxidized materials 1-A1 to 1-A13 and the internally oxidized materials 1-B1 to 1-B9 of the comparative embodiment were not subjected to the heat treatment for diffusion, aggregation, and growth of precipitated oxides, rivet-shaped electrical contacts (hereinafter referred to as internally oxidized electrical contacts, Comparative Embodiments 1-a1 to 1-a13 and Comparative Embodiments 1-b1 to 1-b9) were produced using a header machine.

The metallographic structure of various electrical contacts thus obtained was observed by using a scanning electron microscope (magnification: 20,000 times).

Figure 7:
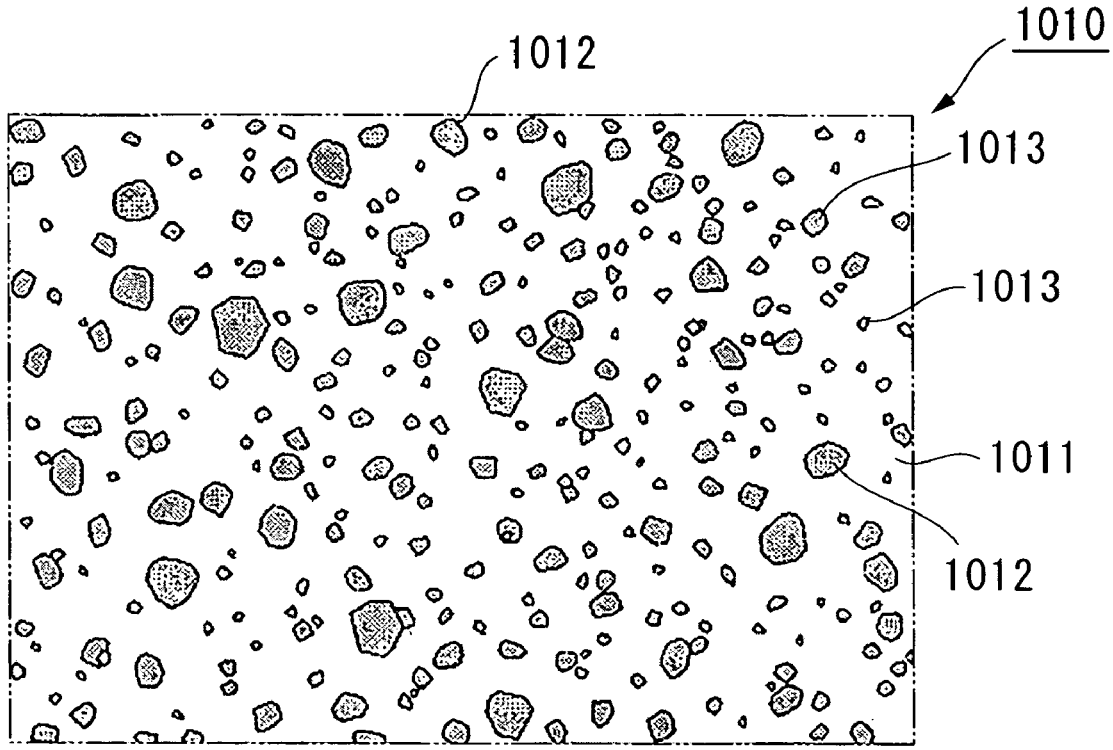
FIG. 7 is a schematic view showing a metallographic structure (magnification: 20,000 times) of a conventional electrical contact of Comparative Embodiment 1-a3.

FIG. 1 is a schematic view showing a metallographic structure of an electrical contact of Embodiment 1-3 according to the first aspect of the present invention, and FIG. 7 is a schematic view showing a metallographic structure of a conventional electrical contact (internally oxidized electrical contact) of Comparative Embodiment 1-a3.

In any of electrical contacts 10 of Embodiments 1-1 to 1-13, ultra-fine particles of Sn-based oxides and In-based oxides do not exist in the state of being precipitated by the internal oxidation treatment. It has been found that, in any of electrical contacts 10 of Embodiments 1-1 to 1-13, the material constituting the electrical contact has a metallographic structure such that coarse grains of composite oxides 12 are dispersed and distributed in an Ag matrix 11, the coarse grains of composite oxides being formed as a result of coarsening of ultra-fine grains of Sn-based oxides and ultra-fine grains of In-based oxides, which are precipitated by the internal oxidation treatment, by the heat treatment for diffusion, aggregation, and growth of the precipitated oxides.

In contrast, in any of conventional electrical contacts (internally oxidized electrical contacts) 1010 of Comparative Embodiments 1-a1 to 1-a13, the material constituting the electrical contact has a metallographic structure such that ultra-fine particles of Sn-based oxides 1012 and In-based oxides 1013 exist in an Ag matrix 1011 in the state of being precipitated by the internal oxidation treatment.

The same metallographic structure as that of the electrical contacts (internally oxidized electrical contacts) of Comparative Embodiments 1-a1 to 1-a13 was also observed in the electrical contacts containing no Bi as an alloy component of Comparative Embodiments 1-1 to 1-9 and the electrical contacts (internally oxidized electrical contacts) of Comparative Embodiments 1-b 1 to 1-b9.

The electrical contacts of different types described above were subjected to switching test with an ASTM electrical contact tester under the following conditions, to determine the number of switching cycles performed before failure (Endurance switching cycles).

Motor lock loading method
Power voltage: 14 VDC
Rated current: 23 A
Contact closing force: 15 gf
Contact opening force: 15 gf These results are shown in Table 1-2 and Table 1-3.

For the purpose of evaluating the electrical conductivity of the electrical contacts, measurement results of electrical conductivity (% IACS) are shown in Table 1-2 and Table 1-3 and also measurement results of Microvickers hardness (Hv) are also shown.

TABLE 1-2

| | Internally oxidized material | Electrical conductivity (% IACS) | Hardness (Hv) | Endurance switching cycles ($\times 10^3$) |
|---|---|---|---|---|
| Embodiment 1-1 | 1-A1 | 80 | 89 | 12.1 |
| Embodiment 1-2 | 1-A2 | 78 | 92 | 13.5 |
| Embodiment 1-3 | 1-A3 | 77 | 94 | 19.6 |
| Embodiment 1-4 | 1-A4 | 75 | 94 | 17.9 |
| Embodiment 1-5 | 1-A5 | 74 | 97 | 14.0 |
| Embodiment 1-6 | 1-A6 | 78 | 91 | 10.4 |
| Embodiment 1-7 | 1-A7 | 77 | 93 | 11.3 |
| Embodiment 1-8 | 1-A8 | 75 | 96 | 18.1 |
| Embodiment 1-9 | 1-A9 | 74 | 96 | 15.2 |
| Embodiment 1-10 | 1-A10 | 77 | 95 | 14.6 |
| Embodiment 1-11 | 1-A11 | 77 | 94 | 17.4 |
| Embodiment 1-12 | 1-A12 | 77 | 92 | 19.0 |
| Embodiment 1-13 | 1-A13 | 76 | 94 | 20.8 |

TABLE 1-2-continued

| | Internally oxidized material | Electrical conductivity (% IACS) | Hardness (Hv) | Endurance switching cycles ($\times 10^3$) |
|---|---|---|---|---|
| Comparative Embodiment 1-1 | 1-B1 | 72 | 101 | 2.5 |
| Comparative Embodiment 1-2 | 1-B2 | 72 | 103 | 4.1 |
| Comparative Embodiment 1-3 | 1-B3 | 69 | 110 | 5.4 |
| Comparative Embodiment 1-4 | 1-B4 | 67 | 112 | 5.0 |
| Comparative Embodiment 1-5 | 1-B5 | 65 | 115 | 3.3 |
| Comparative Embodiment 1-6 | 1-B6 | 72 | 104 | 3.2 |
| Comparative Embodiment 1-7 | 1-B7 | 71 | 107 | 3.7 |
| Comparative Embodiment 1-8 | 1-B8 | 68 | 109 | 4.5 |
| Comparative Embodiment 1-9 | 1-B9 | 66 | 113 | 5.1 |

TABLE 1-3

| | Internally oxidized material | Electrical conductivity (% IACS) | Hardness (Hv) | Endurance switching cycles ($\times 10^3$) |
|---|---|---|---|---|
| Comparative Embodiment 1-a1 | 1-A1 | 71 | 102 | 1.7 |
| Comparative Embodiment 1-a2 | 1-A2 | 70 | 105 | 3.6 |
| Comparative Embodiment 1-a3 | 1-A3 | 67 | 110 | 5.0 |
| Comparative Embodiment 1-a4 | 1-A4 | 66 | 112 | 4.4 |
| Comparative Embodiment 1-a5 | 1-A5 | 65 | 115 | 3.7 |
| Comparative Embodiment 1-a6 | 1-A6 | 71 | 104 | 1.3 |
| Comparative Embodiment 1-a7 | 1-A7 | 70 | 105 | 2.8 |
| Comparative Embodiment 1-a8 | 1-A8 | 67 | 111 | 4.5 |
| Comparative Embodiment 1-a9 | 1-A9 | 65 | 114 | 4.3 |
| Comparative Embodiment 1-a10 | 1-A10 | 67 | 108 | 4.8 |
| Comparative Embodiment 1-a11 | 1-A11 | 67 | 110 | 4.6 |
| Comparative Embodiment 1-a12 | 1-A12 | 67 | 109 | 4.9 |
| Comparative Embodiment 1-a13 | 1-A13 | 67 | 111 | 4.4 |
| Comparative Embodiment 1-b1 | 1-B1 | 71 | 104 | 1.2 |
| Comparative Embodiment 1-b2 | 1-B2 | 71 | 106 | 3.2 |
| Comparative Embodiment 1-b3 | 1-B3 | 67 | 113 | 4.9 |
| Comparative Embodiment 1-b4 | 1-B4 | 66 | 115 | 4.2 |
| Comparative Embodiment 1-b5 | 1-B5 | 65 | 116 | 2.8 |
| Comparative Embodiment 1-b6 | 1-B6 | 71 | 107 | 1.5 |
| Comparative Embodiment 1-b7 | 1-B7 | 70 | 109 | 2.3 |
| Comparative Embodiment 1-b8 | 1-B8 | 67 | 112 | 4.2 |
| Comparative Embodiment 1-b9 | 1-B9 | 65 | 115 | 3.9 |

In the electrical contacts of Embodiments 1-1 to 1-13, as described above, ultra-fine particles of Sn-based oxides and In-based oxides do not exist in the Ag matrix in the state of being precipitated by the internal oxidation treatment, and the ultra-fine particles of these oxides diffuse, aggregate, and grow into coarse grains of composite oxides. As is apparent from the results shown in Table 1-2 and Table 1-3, any of the electrical contacts of Embodiments 1-1 to 1-13 has excellent electrical conductivity. Therefore, heat generation between the contacts is significantly suppressed. As a result, softening of the electrical contact by the heating thereof is suppressed and excellent durability against fusing of the contacts can be maintained. Consequently, the head diameter of the rivet-shape is reduced to 2.3 mm and thus a very long service life can be obtained in an on-off test under service conditions at high current density.

In contrast, in the electrical contacts of Comparative Embodiments 1-a1 to 1-a13, Comparative Embodiments 1-b1 to 1-b9 and Comparative Embodiments 1-1 to 1-9, as described above, ultra-fine particles of Sn-based oxides and In-based oxides are dispersed and distributed in the Ag matrix in the state of being precipitated by the internal oxidation treatment, thus any of them has low electrical conductivity. Therefore, greater heat generation occurs between the contacts under service conditions at high current density, thus making it difficult to maintain excellent welding resistance, eventually reaching the end of service life in a relatively short period of time.

As described above, the electrical contacts according to the first aspect of the present invention demonstrates excellent electrical contact characteristics over a long period of time, that is, high welding resistance and high wear resistance, even if greater current density per unit area is caused by size reduction, and is therefore suitable for an electromagnetic relay which is made smaller in size.

(Second Aspect)

Each of Ag alloys having the composition shown in Table 2-1 was melted by a high frequency induction melting furnace and then casted into a columnar ingot. The ingot was heat-extruded at a temperature of 700° C. to form a plate 30 mm in width×10 mm in thickness, which was hot-rolled at a temperature of 700° C. to form a plate 30 mm in width×3 mm in thickness, and then the plate was cold-rolled while subjecting to intermediate annealing to form a thin plate 30 mm in width×0.6 mm in thickness. The resulting thin plate was cut along the longitudinal direction at intervals of 2 mm in width to form a strip 30 mm in length×2 mm in width×0.6 mm in thickness.

The strip was subjected to an internal oxidation treatment under the conditions of maintaining at 700° C. in an oxygen atmosphere for 24 hours, and the strip subjected to the internal oxidation treatment was put in a die and then compressed to form a columnar formed article 70 mm in diameter×70 mm in length.

The columnar formed article was subjected to a heat treatment for diffusion, aggregation, and growth of precipitated oxides under the conditions of maintaining at predetermined temperature ranging from 900 to 950° C. in an air atmosphere for 12 hours.

The heat-treated columnar formed article was hot-extruded at a temperature of 800° C. to form a wire rod of 7 mm in diameter, which was then hot-drawn at a temperature of 800° C. to form a wire rod of 1.4 mm in diameter.

Using a header machine, rivet-shaped electrical contacts 2.3 mm in head diameter×0.3 mm in head thickness×1.5 mm in leg diameter×1.5 mm in leg length according to the second aspect of the present invention (Embodiments 2-1 to 2-17) were produced from the wire rods.

Under the same conditions as described above, except that each of the Ag alloy ingots shown in Table 2-2, that is, Ag alloy ingots containing no Bi as an alloy component, was used and the columnar formed article was not subjected to the heat treatment for diffusion, aggregation, and growth of precipitated oxides, conventional electrical contacts (Comparative Embodiments 2-1 to 2-13) were produced for comparison.

TABLE 2-1

| | Components of Ag alloy (% by weight) | | | | | Electrical conductivity | Hardness | Endurance switching cycles |
|---|---|---|---|---|---|---|---|---|
| | Sn | In | Ni | Bi | Ag + Impurities | (% IACS) | (Hv) | ($\times 10^3$) |
| Embodiment 2-1 | 5.13 | 3.01 | 0.15 | 0.029 | Balance | 79 | 91 | 11.2 |
| Embodiment 2-2 | 6.04 | 3.04 | 0.14 | 0.027 | Balance | 77 | 93 | 13.7 |
| Embodiment 2-3 | 7.05 | 3.01 | 0.17 | 0.030 | Balance | 76 | 94 | 20.5 |
| Embodiment 2-4 | 7.96 | 3.03 | 0.15 | 0.029 | Balance | 74 | 96 | 18.8 |
| Embodiment 2-5 | 8.92 | 3.06 | 0.13 | 0.031 | Balance | 73 | 98 | 14.3 |
| Embodiment 2-6 | 7.06 | 1.52 | 0.14 | 0.033 | Balance | 78 | 92 | 10.3 |
| Embodiment 2-7 | 7.02 | 2.23 | 0.16 | 0.026 | Balance | 76 | 93 | 11.9 |
| Embodiment 2-8 | 7.05 | 3.90 | 0.13 | 0.029 | Balance | 74 | 95 | 19.6 |
| Embodiment 2-9 | 7.12 | 4.96 | 0.15 | 0.027 | Balance | 73 | 97 | 15.5 |
| Embodiment 2-10 | 7.05 | 3.02 | 0.032 | 0.026 | Balance | 75 | 94 | 19.8 |
| Embodiment 2-11 | 6.98 | 3.04 | 0.27 | 0.028 | Balance | 74 | 95 | 17.3 |
| Embodiment 2-12 | 7.10 | 2.98 | 0.35 | 0.032 | Balance | 75 | 95 | 18.1 |
| Embodiment 2-13 | 7.02 | 3.01 | 0.48 | 0.034 | Balance | 73 | 97 | 15.6 |
| Embodiment 2-14 | 7.05 | 3.05 | 0.16 | 0.0054 | Balance | 74 | 96 | 14.9 |
| Embodiment 2-15 | 7.12 | 3.11 | 0.14 | 0.013 | Balance | 75 | 95 | 17.2 |
| Embodiment 2-16 | 6.93 | 2.96 | 0.15 | 0.041 | Balance | 76 | 93 | 18.7 |
| Embodiment 2-17 | 7.02 | 3.03 | 0.16 | 0.058 | Balance | 76 | 93 | 23.1 |

TABLE 2-2

| | Components of Ag alloy (% by weight) | | | | | Electrical conductivity | Hardness | Endurance switching cycles |
|---|---|---|---|---|---|---|---|---|
| | Sn | In | Ni | Bi | Ag + Impurities | (% IACS) | (Hv) | ($\times 10^3$) |
| Comparative Embodiment 2-1 | 5.12 | 3.03 | 0.13 | — | Balance | 71 | 103 | 0.9 |
| Comparative Embodiment 2-2 | 6.06 | 3.05 | 0.15 | — | Balance | 70 | 107 | 2.8 |
| Comparative Embodiment 2-3 | 7.03 | 3.03 | 0.14 | — | Balance | 67 | 110 | 4.7 |
| Comparative Embodiment 2-4 | 8.01 | 3.06 | 0.15 | — | Balance | 66 | 113 | 4.1 |
| Comparative Embodiment 2-5 | 8.91 | 3.05 | 0.14 | — | Balance | 65 | 116 | 2.4 |
| Comparative Embodiment 2-6 | 7.00 | 1.56 | 0.15 | — | Balance | 71 | 106 | 1.1 |
| Comparative Embodiment 2-7 | 7.04 | 2.21 | 0.14 | — | Balance | 70 | 108 | 2.0 |
| Comparative Embodiment 2-8 | 7.01 | 4.01 | 0.13 | — | Balance | 67 | 112 | 3.8 |
| Comparative Embodiment 2-9 | 7.03 | 4.93 | 0.15 | — | Balance | 65 | 114 | 3.5 |
| Comparative Embodiment 2-10 | 7.06 | 3.08 | 0.035 | — | Balance | 67 | 109 | 4.1 |
| Comparative Embodiment 2-11 | 7.09 | 3.01 | 0.25 | — | Balance | 67 | 110 | 4.4 |
| Comparative Embodiment 2-12 | 7.08 | 3.12 | 0.37 | — | Balance | 67 | 110 | 3.9 |
| Comparative Embodiment 2-13 | 7.07 | 3.05 | 0.46 | — | Balance | 67 | 112 | 3.1 |

The metallographic structure of various electrical contacts thus obtained was observed by using a scanning electron microscope (magnification: 20,000 times).

Figure 2:
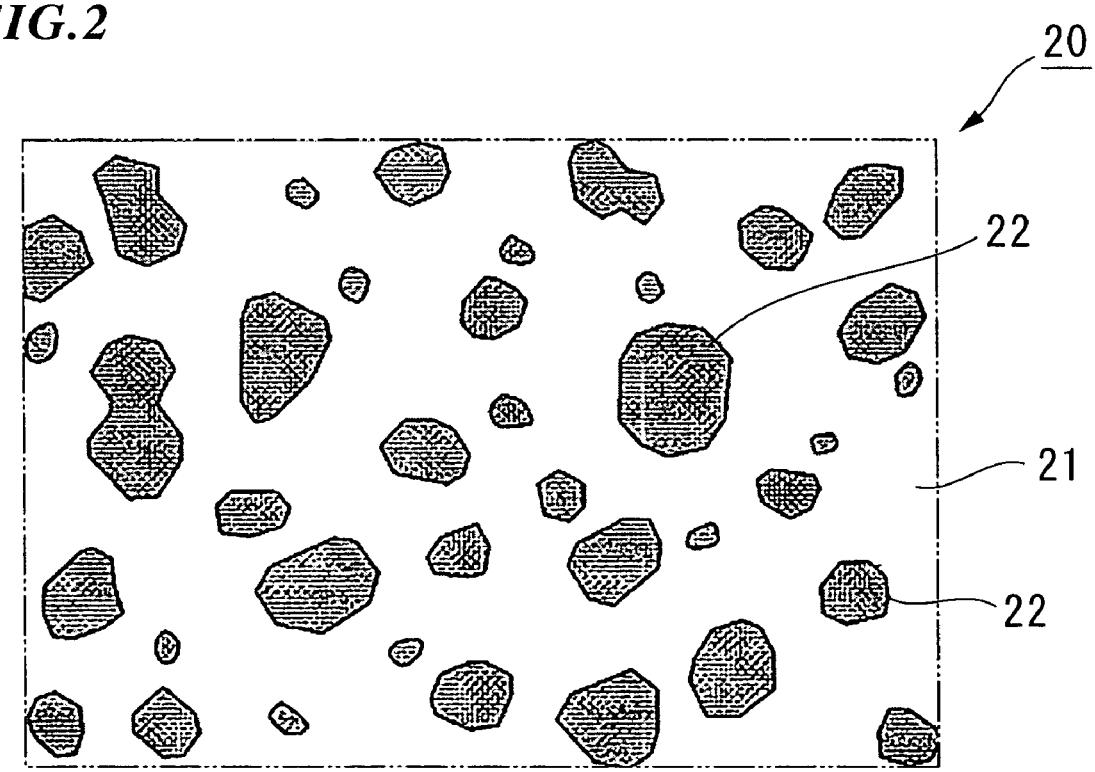
FIG. 2 is a schematic view showing a metallographic structure (magnification: 20,000 times) of an electrical contact of Embodiment 2-3 according to the second aspect of the present invention.
Figure 8:
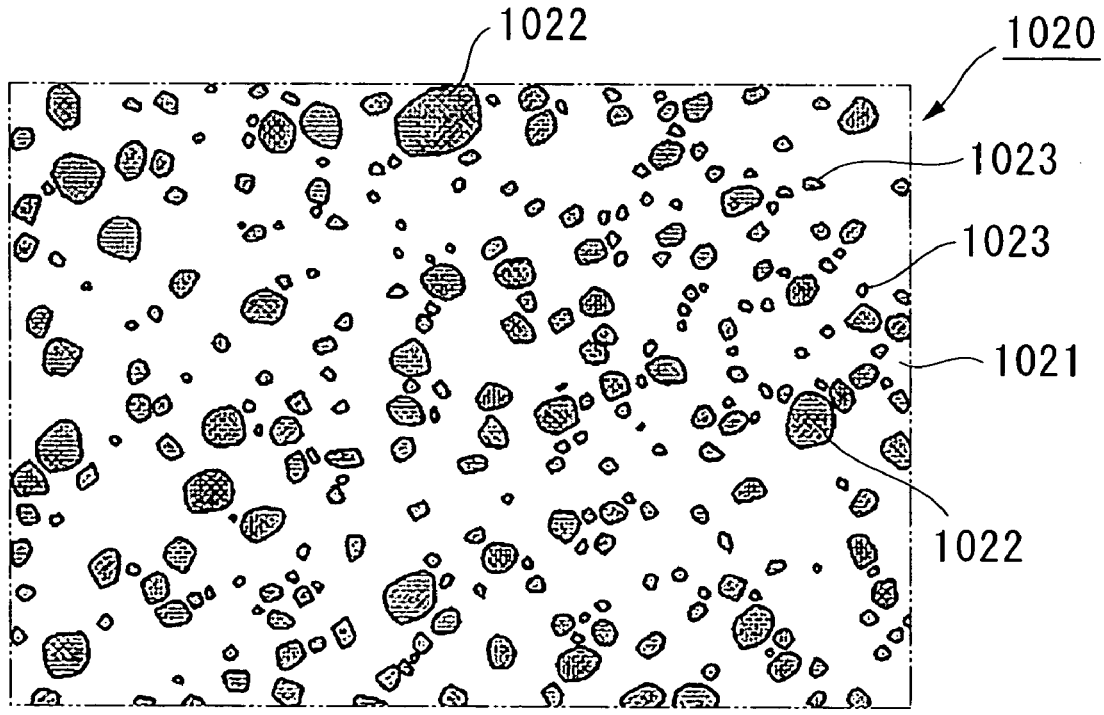
FIG. 8 is a schematic view showing a metallographic structure (magnification: 20,000 times) of a conventional electrical contact of Comparative Embodiment 2-3.

FIG. 2 is a schematic view showing a metallographic structure of an electrical contact of Embodiment 2-3 according to the second aspect of the present invention, and FIG. 8 is a schematic view showing a metallographic structure of a conventional electrical contact of Comparative Embodiment 2-3.

In any of electrical contacts 20 of Embodiments 2-1 to 2-17, ultra-fine particles of Sn-based oxides and In-based oxides do not exist in the state of being precipitated by the internal oxidation treatment. It has been found that, in any of electrical contacts 20 of Embodiments 2-1 to 2-17, the material constituting the electrical contact has a metallographic structure such that coarse grains of composite oxides 22 are dispersed and distributed in an Ag matrix 21, the coarse grains of composite oxides 22 being formed as a result of coarsening of ultra-fine grains of Sn-based oxides and ultra-fine grains of In-based oxides, which are precipitated by the internal oxidation treatment, by the heat treatment for diffusion, aggregation, and growth of the precipitated oxides.

In contrast, in any of conventional electrical contacts (internally oxidized electrical contacts) 1020 of Comparative Embodiments 2-1 to 2-13, the material constituting the electrical contact has a metallographic structure such that ultra-fine particles of Sn-based oxides 1022 and In-based oxides

1023 exist in an Ag matrix 1021 in the state of being precipitated by the internal oxidation treatment.

The electrical contacts of different types described above were subjected to switching test with an ASTM electrical contact tester under the following conditions, to determine the number of switching cycles performed before failure (Endurance switching cycles).

Motor lock loading method
Power voltage: 14 VDC
Rated current: 25 A
Contact closing force: 15 gf
Contact opening force: 15 gf These results are shown in Table 2-1 and Table 2-2.

For the purpose of evaluating the electrical conductivity of the electrical contacts, measurement results of electrical conductivity (% IACS) are shown in Table 2-1 and Table 2-2 and also measurement results of Microvickers hardness (Hv) are also shown.

In the electrical contacts of Embodiments 2-1 to 2-17, as described above, ultra-fine particles of Sn-based oxides and In-based oxides do not exist in the Ag matrix in the state of being precipitated by the internal oxidation treatment, and the ultra-fine particles of these oxides diffuse, aggregate, and grow into coarse grains of composite oxides. As is apparent from the results shown in Table 2-1 and Table 2-2, any of the electrical contacts of Embodiments 2-1 to 2-17 has excellent electrical conductivity. Therefore, heat generation between the contacts is significantly suppressed. As a result, softening of the electrical contact by the heating thereof is suppressed and excellent durability against fusing of the contacts can be maintained. Consequently, the head diameter of the rivet-shape is reduced to 2.3 mm and thus a very long service life can be obtained in an on-off test under service conditions at high current density.

In contrast, in the electrical contacts of Comparative Embodiments 2-1 to 2-13, as described above, ultra-fine particles of Sn-based oxides and In-based oxides are dispersed and distributed in the Ag matrix in the state of being precipitated by the internal oxidation treatment, thus any of them has low electrical conductivity. Therefore, greater heat generation occurs between the contacts under service conditions at high current density, thus making it difficult to maintain excellent welding resistance, eventually reaching the end of service life in a relatively short period of time.

As described above, the electrical contacts according to the second aspect of the present invention demonstrates excellent electrical contact characteristics over a long period of time, that is, high welding resistance and high wear resistance, even if greater current density per unit area is caused by size reduction, and is therefore suitable for an electromagnetic relay which is made smaller in size.

(Third Aspect)

Each of Ag alloys having the composition shown in Table 3-1 was melted by a high frequency induction melting furnace and then casted into a columnar ingot. The ingot was heat-extruded at a temperature of 700° C. to form a plate 30 mm in width×10 mm in thickness, which was hot-rolled at a temperature of 700° C. to form a plate 30 mm in width×3 mm in thickness, and then the plate was cold-rolled while subjecting to intermediate annealing to form a thin plate 30 mm in width×0.6 mm in thickness. The resulting thin plate was cut along the longitudinal direction at intervals of 2 mm in width to form a strip 30 mm in length×2 mm in width×0.6 mm in thickness.

The strip was subjected to an internal oxidation treatment under the conditions of maintaining at 700° C. in an oxygen atmosphere for 24 hours, and the strip subjected to the internal oxidation treatment was put in a die and then compressed to form a columnar formed article 70 mm in diameter×70 mm in length.

The columnar formed article was subjected to a heat treatment for diffusion, aggregation, and growth of precipitated oxides under the conditions of maintaining at predetermined temperature ranging from 900 to 950° C. in an air atmosphere for 12 hours.

The heat-treated columnar formed article was hot-extruded at a temperature of 800° C. to form a wire rod of 7 mm in diameter, which was then hot-drawn at a temperature of 800° C. to form a wire rod of 1.4 mm in diameter.

Using a header machine, rivet-shaped electrical contacts 2.3 mm in head diameter×0.3 mm in head thickness×1.5 mm in leg diameter×1.5 mm in leg length according to the third aspect of the present invention (Embodiments 3-1 to 3-21) were produced from the wire rods.

Under the same conditions as described above, except that each of the Ag alloy ingots shown in Table 3-2, that is, Ag alloy ingots containing no Bi as an alloy component, was used and the columnar formed article was not subjected to the heat treatment for diffusion, aggregation, and growth of precipitated oxides, conventional electrical contacts (Comparative Embodiments 3-1 to 3-13) were produced for comparison.

TABLE 3-1

| | Components of Ag alloy (% by weight) | | | | | | Electrical conductivity | Hardness | Endurance switching cycles |
|---|---|---|---|---|---|---|---|---|---|
| | Sn | In | Cu | Bi | Ni | Ag + Impurities | (% IACS) | (Hv) | ($\times 10^3$) |
| Embodiment 3-1 | 5.12 | 2.89 | 0.40 | 0.031 | — | Balance | 80 | 90 | 12.4 |
| Embodiment 3-2 | 6.01 | 3.02 | 0.43 | 0.029 | — | Balance | 78 | 94 | 15.2 |
| Embodiment 3-3 | 7.01 | 2.97 | 0.42 | 0.033 | — | Balance | 77 | 94 | 20.3 |
| Embodiment 3-4 | 8.03 | 3.00 | 0.38 | 0.032 | — | Balance | 75 | 96 | 19.1 |
| Embodiment 3-5 | 8.96 | 3.03 | 0.43 | 0.032 | — | Balance | 74 | 97 | 14.5 |
| Embodiment 3-6 | 6.88 | 1.52 | 0.42 | 0.030 | — | Balance | 79 | 92 | 11.1 |
| Embodiment 3-7 | 6.93 | 2.28 | 0.39 | 0.028 | — | Balance | 78 | 93 | 11.9 |
| Embodiment 3-8 | 7.04 | 3.92 | 0.40 | 0.031 | — | Balance | 75 | 95 | 19.4 |
| Embodiment 3-9 | 7.02 | 4.93 | 0.38 | 0.034 | — | Balance | 74 | 95 | 15.8 |
| Embodiment 3-10 | 6.97 | 3.04 | 0.052 | 0.032 | — | Balance | 76 | 93 | 19.7 |
| Embodiment 3-11 | 6.99 | 3.01 | 0.19 | 0.031 | — | Balance | 77 | 95 | 18.6 |
| Embodiment 3-12 | 7.05 | 3.05 | 0.33 | 0.030 | — | Balance | 76 | 95 | 20.1 |
| Embodiment 3-13 | 7.03 | 2.99 | 0.49 | 0.029 | — | Balance | 76 | 97 | 18.3 |
| Embodiment 3-14 | 6.96 | 3.03 | 0.38 | 0.0052 | — | Balance | 76 | 98 | 16.2 |
| Embodiment 3-15 | 7.02 | 3.01 | 0.41 | 0.014 | — | Balance | 77 | 94 | 17.5 |
| Embodiment 3-16 | 6.98 | 3.05 | 0.43 | 0.042 | — | Balance | 77 | 94 | 19.3 |
| Embodiment 3-17 | 7.05 | 3.04 | 0.40 | 0.057 | — | Balance | 76 | 95 | 18.8 |

TABLE 3-1-continued

| | Components of Ag alloy (% by weight) | | | | | | Electrical conductivity | Hardness | Endurance switching cycles |
|---|---|---|---|---|---|---|---|---|---|
| | Sn | In | Cu | Bi | Ni | Ag + Impurities | (% IACS) | (Hv) | ($\times 10^3$) |
| Embodiment 3-18 | 7.03 | 3.01 | 0.37 | 0.030 | 0.034 | Balance | 77 | 95 | 21.5 |
| Embodiment 3-19 | 6.98 | 3.04 | 0.39 | 0.032 | 0.28 | Balance | 76 | 97 | 23.1 |
| Embodiment 3-20 | 7.06 | 2.97 | 0.39 | 0.032 | 0.35 | Balance | 76 | 96 | 22.2 |
| Embodiment 3-21 | 7.01 | 3.02 | 0.38 | 0.033 | 0.47 | Balance | 76 | 97 | 20.6 |

TABLE 3-2

| | Components of Ag alloy (% by weight) | | | | | Electrical conductivity | Hardness | Endurance switching cycles |
|---|---|---|---|---|---|---|---|---|
| | Sn | In | Cu | Bi | Ag + Impurities | (% IACS) | (Hv) | ($\times 10^3$) |
| Comparative Embodiment 3-1 | 5.12 | 3.03 | 0.31 | — | Balance | 71 | 104 | 0.8 |
| Comparative Embodiment 3-2 | 6.06 | 3.05 | 0.30 | — | Balance | 71 | 106 | 2.7 |
| Comparative Embodiment 3-3 | 7.03 | 3.03 | 0.28 | — | Balance | 68 | 110 | 3.9 |
| Comparative Embodiment 3-4 | 8.01 | 3.06 | 0.32 | — | Balance | 67 | 115 | 3.0 |
| Comparative Embodiment 3-5 | 8.91 | 3.05 | 0.28 | — | Balance | 66 | 116 | 2.4 |
| Comparative Embodiment 3-6 | 7.00 | 1.56 | 0.30 | — | Balance | 71 | 105 | 1.1 |
| Comparative Embodiment 3-7 | 7.04 | 2.21 | 0.29 | — | Balance | 70 | 109 | 1.8 |
| Comparative Embodiment 3-8 | 7.01 | 4.01 | 0.32 | — | Balance | 67 | 114 | 3.5 |
| Comparative Embodiment 3-9 | 7.03 | 4.93 | 0.29 | — | Balance | 65 | 116 | 3.1 |
| Comparative Embodiment 3-10 | 7.06 | 3.08 | 0.053 | — | Balance | 68 | 109 | 3.4 |
| Comparative Embodiment 3-11 | 7.09 | 3.01 | 0.15 | — | Balance | 68 | 107 | 3.8 |
| Comparative Embodiment 3-12 | 7.08 | 3.12 | 0.39 | — | Balance | 67 | 112 | 4.0 |
| Comparative Embodiment 3-13 | 7.07 | 3.05 | 0.49 | — | Balance | 68 | 110 | 2.9 |

The metallographic structure of various electrical contacts thus obtained was observed by using a scanning electron microscope (magnification: 20,000 times).

Figure 3:
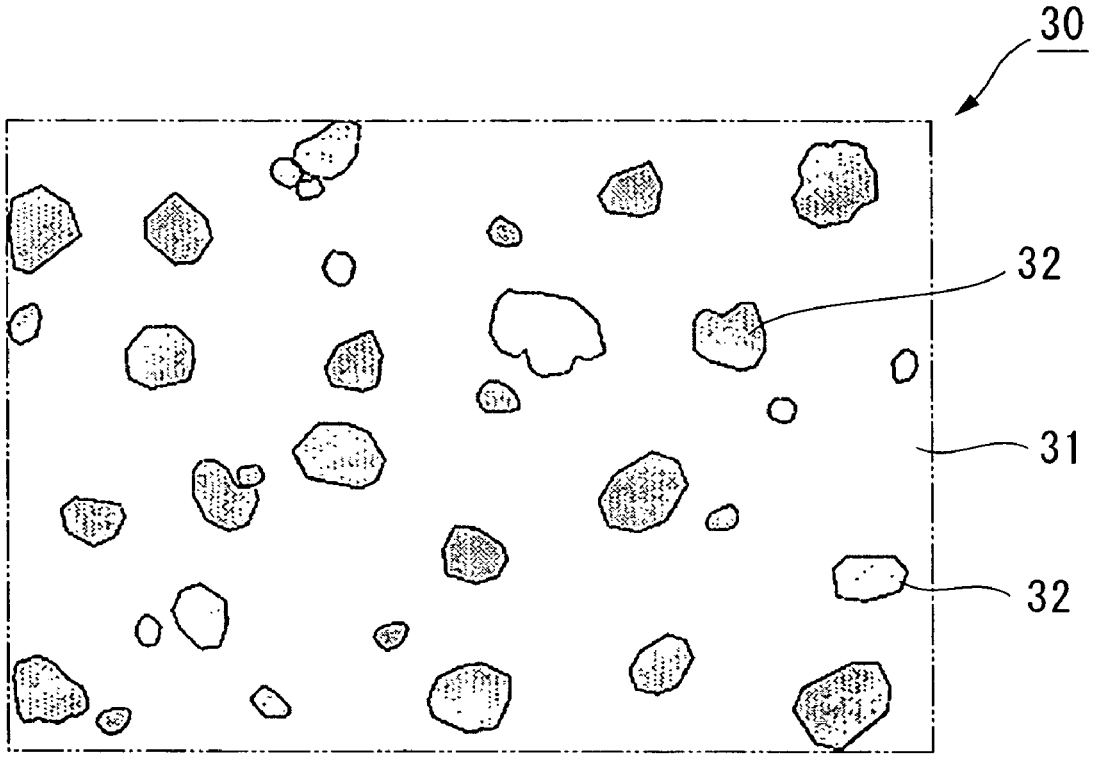
FIG. 3 is a schematic view showing a metallographic structure (magnification: 20,000 times) of an electrical contact of Embodiment 3-3 according to the third aspect of the present invention.
Figure 9:
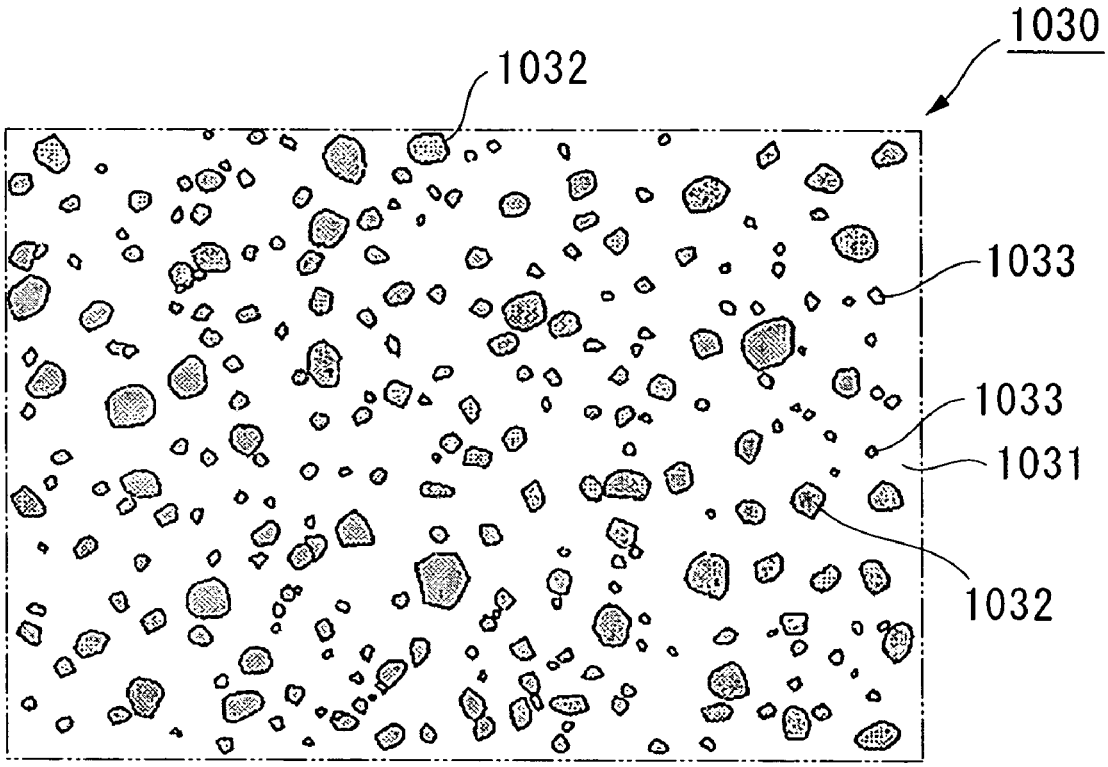
FIG. 9 is a schematic view showing a metallographic structure (magnification: 20,000 times) of a conventional electrical contact of Comparative Embodiment 3-3.

FIG. 3 is a schematic view showing a metallographic structure of an electrical contact of Embodiment 3-3 according to the third aspect of the present invention, and FIG. 9 is a schematic view showing a metallographic structure of a conventional electrical contact (internally oxidized electrical contact) of Comparative Embodiment 3-3.

In any of electrical contacts 30 of Embodiments 3-1 to 3-21, ultra-fine particles of Sn-based oxides and In-based oxides do not exist in the state of being precipitated by the internal oxidation treatment. It has been found that, in any of electrical contacts 30 of Embodiments 3-1 to 3-21, the material constituting the electrical contact has a metallographic structure such that coarse grains of composite oxides 32 are dispersed and distributed in an Ag matrix 31, the coarse grains of composite oxides 32 being formed as a result of coarsening of ultra-fine grains of oxides, which are precipitated by the internal oxidation treatment, by the heat treatment for diffusion, aggregation, and growth of the precipitated oxides.

In contrast, in any of conventional electrical contacts 1030 of Comparative Embodiments 3-1 to 3-13, the material constituting the electrical contact has a metallographic structure such that ultra-fine particles of Sn-based oxides 1032 and In-based oxides 1033 exist in an Ag matrix 1031 in the state of being precipitated by the internal oxidation treatment.

The electrical contacts of different types described above were subjected to switching test with an ASTM electrical contact tester under the following conditions, to determine the number of switching cycles performed before failure (Endurance switching cycles).

Motor lock loading method
Power voltage: 14 VDC
Rated current: 28 A
Contact closing force: 15 gf
Contact opening force: 15 gf These results are shown in Table 3-1 and Table 3-2.

For the purpose of evaluating the electrical conductivity of the electrical contacts, measurement results of electrical conductivity (% IACS) are shown in Table 3-1 and Table 3-2 and also measurement results of Microvickers hardness (Hv) are also shown.

In the electrical contacts of Embodiments 3-1 to 3-21, as described above, ultra-fine particles of Sn-based oxides and In-based oxides do not exist in the Ag matrix in the state of being precipitated by the internal oxidation treatment, and the ultra-fine particles of these oxides diffuse, aggregate, and grow into coarse grains of composite oxides. As is apparent from the results shown in Table 3-1 and Table 3-2, any of the electrical contacts of Embodiments 3-1 to 3-21 has excellent electrical conductivity. Therefore, heat generation between the contacts is significantly suppressed. As a result, softening of the electrical contact by the heating thereof is suppressed and excellent durability against fusing of the contacts can be maintained. Consequently, the head diameter of the rivet-shape is reduced to 2.3 mm and thus a very long service life can be obtained in an on-off test under service conditions at high current density.

In contrast, in the electrical contacts of Comparative Embodiments 3-1 to 3-13, as described above, ultra-fine particles of Sn-based oxides and In-based oxides are dispersed and distributed in the Ag matrix in the state of being precipitated by the internal oxidation treatment, thus any of them has low electrical conductivity. Therefore, greater heat generation occurs between the contacts under service conditions at high current density, thus making it difficult to maintain excellent welding resistance, eventually reaching the end of service life in a relatively short period of time.

As described above, the electrical contacts according to the third aspect of the present invention demonstrates excellent electrical contact characteristics over a long period of time, that is, high welding resistance and high wear resistance, even if greater current density per unit area is caused by size reduction, and is therefore suitable for an electromagnetic relay which is made smaller in size.

(Fourth Aspect)

Each of Ag alloys having the composition shown in Table 4-1 was melted by a high frequency induction melting furnace and then casted into a columnar ingot. The ingot was heat-extruded at a temperature of 700° C. to form a plate 30 mm in width×10 mm in thickness, which was hot-rolled at a temperature of 700° C. to form a plate 30 mm in width×3 mm in thickness, and then the plate was cold-rolled while subjecting to intermediate annealing to form a thin plate 30 mm in width×0.6 mm in thickness. The resulting thin plate was cut along the longitudinal direction at intervals of 2 mm in width to form a strip 30 mm in length×2 mm in width×0.6 mm in thickness.

The strip was subjected to an internal oxidation treatment under the conditions of maintaining at 700° C. in an oxygen atmosphere for 24 hours to obtain internally oxidized Ag alloys (hereinafter referred to as internally oxidized materials) 4-Al to 4-A13, Ni-containing internally oxidized materials 4-B1 to 4-B4 and internally oxidized materials 4-C1 to 4-C13 of comparative embodiments.

TABLE 4-1

| Internally oxidized | Components of Ag alloy (% by weight) | | | | |
|---|---|---|---|---|---|
| material | Sn | In | Te | Ni | Ag + Impurities |
| 4-A1 | 5.11 | 2.96 | 0.41 | — | Balance |
| 4-A2 | 6.10 | 2.89 | 0.38 | — | Balance |
| 4-A3 | 7.08 | 3.04 | 0.43 | — | Balance |
| 4-A4 | 8.04 | 2.87 | 0.40 | — | Balance |
| 4-A5 | 8.95 | 3.01 | 0.38 | — | Balance |
| 4-A6 | 6.88 | 1.54 | 0.43 | — | Balance |
| 4-A7 | 6.92 | 2.25 | 0.39 | — | Balance |
| 4-A8 | 7.01 | 3.88 | 0.43 | — | Balance |
| 4-A9 | 6.96 | 4.93 | 0.41 | — | Balance |
| 4-A10 | 7.04 | 2.99 | 0.053 | — | Balance |
| 4-A11 | 7.05 | 3.07 | 0.26 | — | Balance |
| 4-A12 | 6.97 | 3.01 | 0.63 | — | Balance |
| 4-A13 | 7.06 | 3.06 | 0.78 | — | Balance |
| 4-B1 | 6.96 | 3.02 | 0.39 | 0.034 | Balance |
| 4-B2 | 6.87 | 2.98 | 0.42 | 0.28 | Balance |
| 4-B3 | 7.06 | 3.03 | 0.38 | 0.39 | Balance |
| 4-B4 | 7.08 | 3.08 | 0.40 | 0.47 | Balance |

TABLE 4-1-continued

| Internally oxidized | Components of Ag alloy (% by weight) | | | | |
|---|---|---|---|---|---|
| material | Sn | In | Te | Ni | Ag + Impurities |
| 4-C1 | 5.15 | 2.99 | — | — | Balance |
| 4-C2 | 6.04 | 2.87 | — | — | Balance |
| 4-C3 | 6.89 | 3.03 | — | — | Balance |
| 4-C4 | 8.03 | 3.01 | — | — | Balance |
| 4-C5 | 8.96 | 3.06 | — | — | Balance |
| 4-C6 | 6.89 | 1.57 | — | — | Balance |
| 4-C7 | 7.06 | 2.27 | — | — | Balance |
| 4-C8 | 6.88 | 4.02 | — | — | Balance |
| 4-C9 | 7.07 | 4.93 | — | — | Balance |
| 4-C10 | 7.02 | 2.96 | — | 0.035 | Balance |
| 4-C11 | 6.99 | 3.04 | — | 0.29 | Balance |
| 4-C12 | 7.08 | 2.96 | — | 0.37 | Balance |
| 4-C13 | 7.01 | 3.04 | — | 0.48 | Balance |

Each of the strip-shaped internally oxidized materials 4-A1 to 4-A13, the Ni-containing internally oxidized materials 4-B1 to 4-B4 and the internally oxidized materials 4-C1 to 4-C13 of the comparative embodiments was put in a die and then compressed to form a columnar formed article 70 mm in diameter×70 mm in length.

The columnar formed article was subjected to a heat treatment for diffusion, aggregation, and growth of precipitated oxides under the conditions of maintaining at predetermined temperature ranging from 900 to 950° C. in an air atmosphere for 12 hours.

The heat-treated columnar formed article was hot-extruded at a temperature of 800° C. to form a wire rod of 7 mm in diameter, which was then hot-drawn at a temperature of 800° C. to form a wire rod of 1.4 mm in diameter.

Using a header machine, rivet-shaped electrical contacts 2.3 mm in head diameter×0.3 mm in head thickness×1.5 mm in leg diameter×1.5 mm in leg length according to the fourth aspect of the present invention (Embodiments 4-1 to 4-17) and electrical contacts containing no Te as an alloy component (Comparative Embodiments 4-1 to 4-13) were produced from the wire rods.

Under the same conditions as described above, except that the strip-shaped internally oxidized materials 4-A1 to 4-A13, the Ni-containing internally oxidized materials 4-B1 to 4-B4 and the internally oxidized materials 4-C1 to 4-C13 of the comparative embodiments were not subjected to the heat treatment for diffusion, aggregation, and growth of precipitated oxides, rivet-shaped electrical contacts (hereinafter referred to as internally oxidized electrical contacts, Comparative Embodiments 4-a1 to 4-a13, Comparative Embodiments 4-b1 to 4-b4 and Comparative Embodiments 4-c1 to 4-c13) were produced using a header machine.

The metallographic structure of various electrical contacts thus obtained was observed by using a scanning electron microscope (magnification: 20,000 times).

Figure 4:
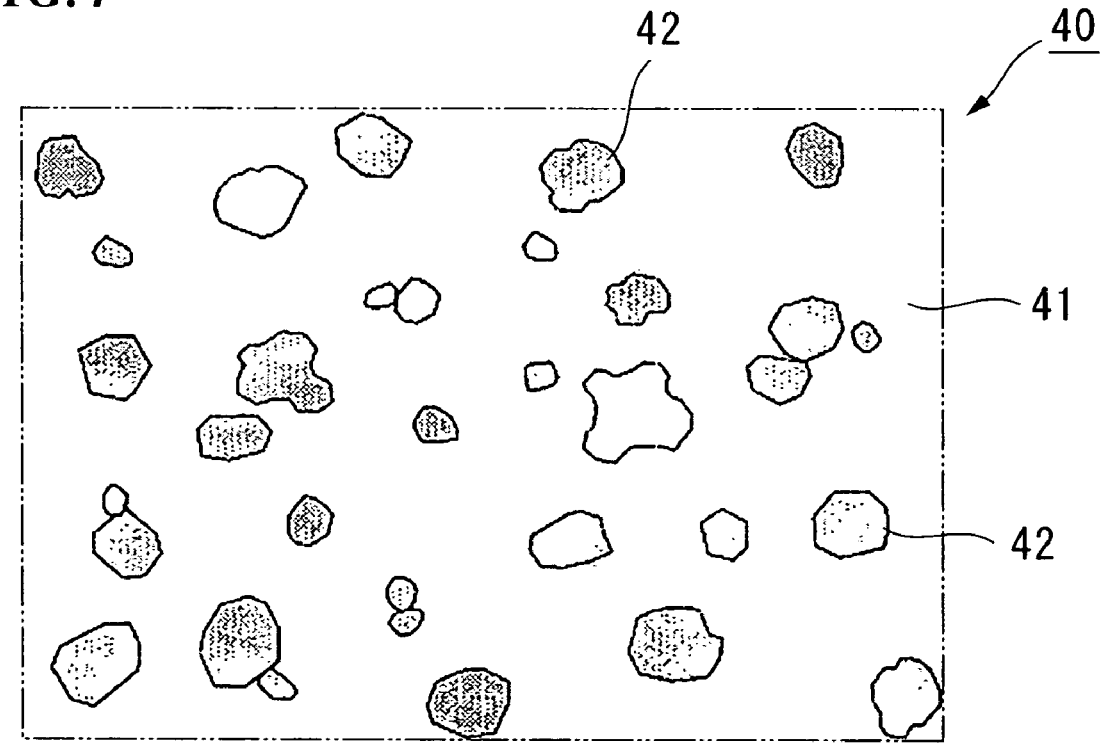
FIG. 4 is a schematic view showing a metallographic structure (magnification: 20,000 times) of an electrical contact of Embodiment 4-3 according to the fourth aspect of the present invention.
Figure 10:
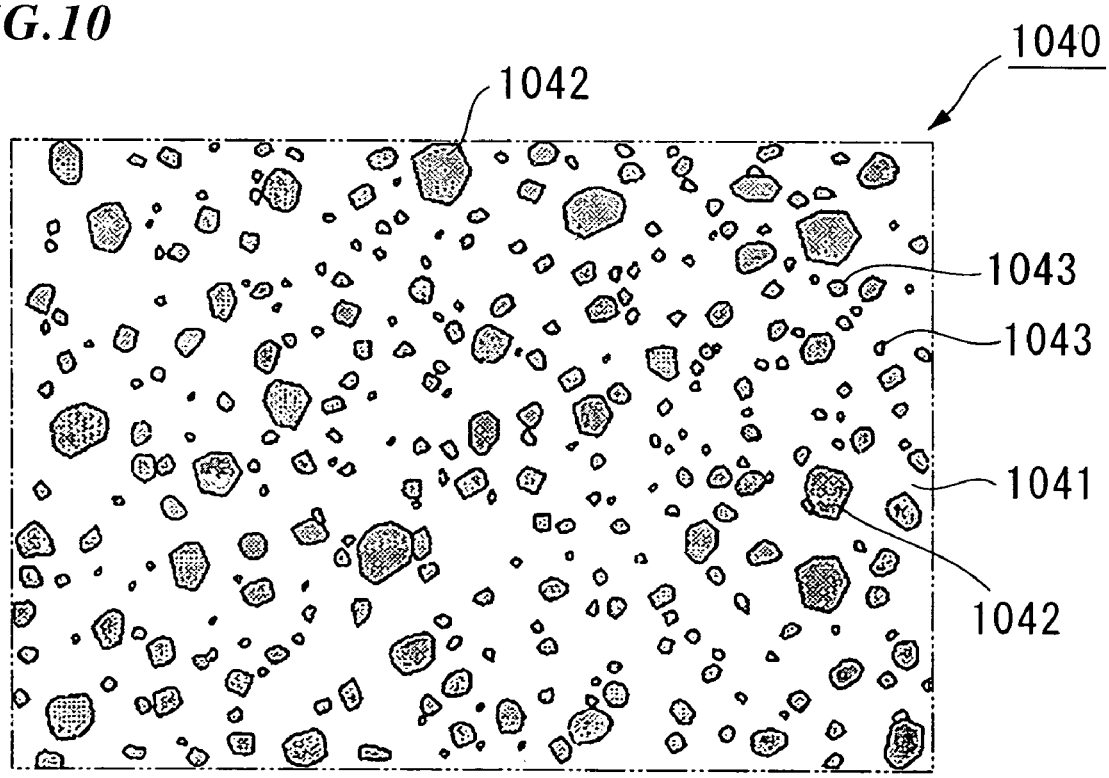
FIG. 10 is a schematic view showing a metallographic structure (magnification: 20,000 times) of a conventional electrical contact of Comparative Embodiment 4-a3.

FIG. 4 is a schematic view showing a metallographic structure of an electrical contact of Embodiment 4-3 according to the fourth aspect of the present invention, and FIG. 10 is a schematic view showing a metallographic structure of a conventional electrical contact (internally oxidized electrical contact) of Comparative Embodiment 4-a3.

In any of electrical contacts 40 of Embodiments 4-1 to 4-17, ultra-fine particles of Sn-based oxides and In-based oxides do not exist in the state of being precipitated by the internal oxidation treatment. It has been found that, in any of electrical contacts 40 of Embodiments 4-1 to 4-17, the material constituting the electrical contact has a metallographic structure such that coarse grains of composite oxides 42 are dispersed and distributed in an Ag matrix 41, the coarse grains of composite oxides being formed as a result of coarsening of ultra-fine grains of oxides, which are precipitated by the internal oxidation treatment, by the heat treatment for diffusion, aggregation, and growth of the precipitated oxides.

In contrast, in any of conventional electrical contacts (internally oxidized electrical contacts) 1040 of Comparative Embodiments 4-a1 to 4-a13, the material constituting the electrical contact has a metallographic structure such that ultra-fine particles of Sn-based oxides 1042 and In-based oxides 1043 exist in an Ag matrix 1041 in the state of being precipitated by the internal oxidation treatment.

The same metallographic structure as that of the electrical contacts (internally oxidized electrical contacts) of Comparative Embodiments 4-a1 to 4-a13 was also observed in the electrical contacts (internally oxidized electrical contacts) of Comparative Embodiments 4-b1 to 4-b4, and the electrical contacts containing no Te as an alloy component of Comparative Embodiments 4-1 to 4-13 and Comparative Embodiments 4-c1 to 4-c13.

The electrical contacts of different types described above were subjected to switching test with an ASTM electrical contact tester under the following conditions, to determine the number of switching cycles performed before failure (Endurance switching cycles).

Motor lock loading method
Power voltage: 14 VDC
Rated current: 30 A
Contact closing force: 20 gf
Contact opening force: 20 gf These results are shown in Table 4-2 and Table 4-3.

For the purpose of evaluating the electrical conductivity of the electrical contacts, measurement results of electrical conductivity (% IACS) are shown in Table 4-2 and Table 4-3 and also measurement results of Microvickers hardness (Hv) are also shown.

TABLE 4-2

| | Internally oxidized material | Electrical conductivity (% IACS) | Hardness (Hv) | Endurance switching cycles ($\times 10^3$) |
|---|---|---|---|---|
| Embodiment 4-1 | 4-A1 | 79 | 89 | 9.8 |
| Embodiment 4-2 | 4-A2 | 77 | 92 | 11.6 |
| Embodiment 4-3 | 4-A3 | 76 | 94 | 18.9 |
| Embodiment 4-4 | 4-A4 | 75 | 95 | 16.5 |
| Embodiment 4-5 | 4-A5 | 74 | 98 | 13.4 |
| Embodiment 4-6 | 4-A6 | 77 | 93 | 10.1 |
| Embodiment 4-7 | 4-A7 | 77 | 95 | 10.9 |
| Embodiment 4-8 | 4-A8 | 75 | 96 | 17.2 |
| Embodiment 4-9 | 4-A9 | 74 | 97 | 15.1 |
| Embodiment 4-10 | 4-A10 | 76 | 96 | 18.1 |
| Embodiment 4-11 | 4-A11 | 76 | 96 | 15.7 |
| Embodiment 4-12 | 4-A12 | 75 | 95 | 16.3 |
| Embodiment 4-13 | 4-A13 | 75 | 97 | 14.2 |
| Embodiment 4-14 | 4-B1 | 76 | 95 | 19.1 |
| Embodiment 4-15 | 4-B2 | 76 | 96 | 20.5 |
| Embodiment 4-16 | 4-B3 | 75 | 95 | 20.9 |
| Embodiment 4-17 | 4-B4 | 75 | 97 | 17.8 |
| Comparative Embodiment 4-1 | 4-C1 | 72 | 99 | 1.1 |
| Comparative Embodiment 4-2 | 4-C2 | 71 | 101 | 3.4 |
| Comparative Embodiment 4-3 | 4-C3 | 69 | 105 | 5.9 |
| Comparative Embodiment 4-4 | 4-C4 | 67 | 106 | 4.3 |
| Comparative Embodiment 4-5 | 4-C5 | 66 | 110 | 2.8 |
| Comparative Embodiment 4-6 | 4-C6 | 72 | 100 | 1.3 |
| Comparative Embodiment 4-7 | 4-C7 | 71 | 104 | 2.5 |

TABLE 4-2-continued

| | Internally oxidized material | Electrical conductivity (% IACS) | Hardness (Hv) | Endurance switching cycles ($\times 10^3$) |
|---|---|---|---|---|
| Comparative Embodiment 4-8 | 4-C8 | 68 | 107 | 4.6 |
| Comparative Embodiment 4-9 | 4-C9 | 67 | 108 | 3.9 |
| Comparative Embodiment 4-10 | 4-C10 | 69 | 103 | 5.8 |
| Comparative Embodiment 4-11 | 4-C11 | 68 | 106 | 6.3 |
| Comparative Embodiment 4-12 | 4-C12 | 68 | 103 | 5.1 |
| Comparative Embodiment 4-13 | 4-C13 | 68 | 109 | 5.5 |

TABLE 4-3

| | Internally oxidized material | Electrical conductivity (% IACS) | Hardness (Hv) | Endurance switching cycles ($\times 10^3$) |
|---|---|---|---|---|
| Comparative Embodiment 4-a1 | 4-A1 | 71 | 105 | 1.6 |
| Comparative Embodiment 4-a2 | 4-A2 | 69 | 108 | 3.1 |
| Comparative Embodiment 4-a3 | 4-A3 | 66 | 111 | 4.9 |
| Comparative Embodiment 4-a4 | 4-A4 | 65 | 113 | 4.3 |
| Comparative Embodiment 4-a5 | 4-A5 | 64 | 115 | 2.8 |
| Comparative Embodiment 4-a6 | 4-A6 | 70 | 108 | 1.5 |
| Comparative Embodiment 4-a7 | 4-A7 | 69 | 109 | 2.0 |
| Comparative Embodiment 4-a8 | 4-A8 | 66 | 114 | 4.1 |
| Comparative Embodiment 4-a9 | 4-A9 | 65 | 115 | 3.6 |
| Comparative Embodiment 4-a10 | 4-A10 | 67 | 110 | 4.2 |
| Comparative Embodiment 4-a11 | 4-A11 | 66 | 111 | 4.5 |
| Comparative Embodiment 4-a12 | 4-A12 | 66 | 113 | 4.8 |
| Comparative Embodiment 4-a13 | 4-A13 | 66 | 113 | 3.7 |
| Comparative Embodiment 4-b1 | 4-B1 | 67 | 110 | 5.1 |
| Comparative Embodiment 4-b2 | 4-B2 | 67 | 114 | 5.6 |
| Comparative Embodiment 4-b3 | 4-B3 | 66 | 114 | 5.5 |
| Comparative Embodiment 4-b4 | 4-B4 | 66 | 115 | 5.0 |
| Comparative Embodiment 4-c1 | 4-C1 | 71 | 102 | 0.6 |
| Comparative Embodiment 4-c2 | 4-C2 | 71 | 105 | 2.4 |
| Comparative Embodiment 4-c3 | 4-C3 | 67 | 108 | 3.7 |
| Comparative Embodiment 4-c4 | 4-C4 | 66 | 112 | 3.3 |
| Comparative Embodiment 4-c5 | 4-C5 | 65 | 117 | 1.8 |
| Comparative Embodiment 4-c6 | 4-C6 | 71 | 105 | 0.8 |
| Comparative Embodiment 4-c7 | 4-C7 | 70 | 110 | 1.6 |
| Comparative Embodiment 4-c8 | 4-C8 | 67 | 111 | 3.1 |
| Comparative Embodiment 4-c9 | 4-C9 | 65 | 112 | 2.6 |
| Comparative Embodiment 4-c10 | 4-C10 | 67 | 108 | 3.7 |

TABLE 4-3-continued

| | Internally oxidized material | Electrical conductivity (% IACS) | Hardness (Hv) | Endurance switching cycles (×10³) |
|---|---|---|---|---|
| Comparative Embodiment 4-c11 | 4-C11 | 67 | 111 | 4.2 |
| Comparative Embodiment 4-c12 | 4-C12 | 67 | 110 | 3.6 |
| Comparative Embodiment 4-c13 | 4-C13 | 67 | 114 | 3.1 |

In the electrical contacts of Embodiments 4-1 to 4-17, as described above, ultra-fine particles of Sn-based oxides and In-based oxides do not exist in the Ag matrix in the state of being precipitated by the internal oxidation treatment, and the ultra-fine particles of these oxides diffuse, aggregate, and grow into coarse grains of composite oxides. As is apparent from the results shown in Table 4-2 and Table 4-3, any of the electrical contacts of Embodiments 4-1 to 4-17 has excellent electrical conductivity. Therefore, heat generation between the contacts is significantly suppressed. As a result, softening of the electrical contact by the heating thereof is suppressed and excellent durability against fusing of the contacts can be maintained. Consequently, the head diameter of the rivet-shape is reduced to 2.3 mm and thus a very long service life can be obtained in an on-off test under service conditions at high current density.

In contrast, in the electrical contacts of Comparative Embodiments 4-a1 to 4-a13, Comparative Embodiments 4-b1 to 4-b4, Comparative Embodiments 4-c1 to 4-c13 and Comparative Embodiments 4-1 to 4-13, as described above, ultra-fine particles of Sn-based oxides and In-based oxides are dispersed and distributed in the Ag matrix in the state of being precipitated by the internal oxidation treatment, thus any of them has low electrical conductivity. Therefore, greater heat generation occurs between the contacts under service conditions at high current density, thus making it difficult to maintain excellent welding resistance, eventually reaching the end of service life in a relatively short period of time.

As described above, the electrical contacts according to the fourth aspect of the present invention demonstrates excellent electrical contact characteristics over a long period of time, that is, high welding resistance and high wear resistance, even if greater current density per unit area is caused by size reduction, and is therefore suitable for an electromagnetic relay which is made smaller in size.

(Fifth Aspect)

Each of Ag alloys having the composition shown in Table 5-1 was melted by a high frequency induction melting furnace and then casted into a columnar ingot. The ingot was heat-extruded at a temperature of 700° C. to form a plate 30 mm in width×10 mm in thickness, which was hot-rolled at a temperature of 700° C. to form a plate 30 mm in width×3 mm in thickness, and then the plate was cold-rolled while subjecting to intermediate annealing to form a thin plate 30 mm in width×0.6 mm in thickness. The resulting thin plate was cut along the longitudinal direction at intervals of 2 mm in width to form a strip 30 mm in length×2 mm in width×0.6 mm in thickness.

The strip was subjected to an internal oxidation treatment under the conditions of maintaining at 700° C. in an oxygen atmosphere for 24 hours, and the strip subjected to the internal oxidation treatment was put in a die and then compressed to form a columnar formed article 70 mm in diameter×70 mm in length.

The columnar formed article was subjected to a heat treatment for diffusion, aggregation, and growth of precipitated oxides under the conditions of maintaining at predetermined temperature ranging from 900 to 950° C. in an air atmosphere for 12 hours.

The heat-treated columnar formed article was hot-extruded at a temperature of 800° C. to form a wire rod of 7 mm in diameter, which was then hot-drawn at a temperature of 800° C. to form a wire rod of 1.4 mm in diameter.

Using a header machine, rivet-shaped electrical contacts 2.3 mm in head diameter×0.3 mm in head thickness×1.5 mm in leg diameter×1.5 mm in leg length according to the fifth aspect of the present invention (Embodiments 5-1 to 5-21) were produced from the wire rods.

Under the same conditions as described above, except that each of the Ag alloy ingots shown in Table 5-2, that is, Ag alloy ingots containing no Te as an alloy component, was used and the columnar formed article was not subjected to the heat treatment for diffusion, aggregation, and growth of precipitated oxides, conventional electrical contacts (Comparative Embodiments 5-1 to 5-13) were produced for comparison.

TABLE 5-1

| | Components of Ag alloy (% by weight) | | | | | | Electrical conductivity | Hardness | Endurance switching cycles |
|---|---|---|---|---|---|---|---|---|---|
| | Sn | In | Cu | Te | Ni | Ag + Impurities | (% IACS) | (Hv) | (×10³) |
| Embodiment 5-1 | 5.11 | 3.09 | 0.27 | 0.41 | — | Balance | 80 | 92 | 13.1 |
| Embodiment 5-2 | 5.98 | 3.11 | 0.24 | 0.42 | — | Balance | 79 | 95 | 14.8 |
| Embodiment 5-3 | 6.96 | 3.07 | 0.28 | 0.43 | — | Balance | 78 | 97 | 21.1 |
| Embodiment 5-4 | 8.01 | 3.05 | 0.28 | 0.40 | — | Balance | 75 | 96 | 18.7 |
| Embodiment 5-5 | 8.98 | 3.16 | 0.29 | 0.39 | — | Balance | 74 | 97 | 15.8 |
| Embodiment 5-6 | 7.04 | 1.52 | 0.26 | 0.41 | — | Balance | 79 | 91 | 10.3 |
| Embodiment 5-7 | 7.01 | 2.18 | 0.29 | 0.38 | — | Balance | 78 | 93 | 13.6 |
| Embodiment 5-8 | 6.93 | 3.99 | 0.26 | 0.39 | — | Balance | 76 | 94 | 19.2 |
| Embodiment 5-9 | 7.08 | 4.97 | 0.28 | 0.40 | — | Balance | 74 | 96 | 16.4 |
| Embodiment 5-10 | 6.88 | 3.13 | 0.052 | 0.42 | — | Balance | 78 | 93 | 18.3 |
| Embodiment 5-11 | 7.00 | 3.09 | 0.19 | 0.38 | — | Balance | 77 | 94 | 19.5 |
| Embodiment 5-12 | 7.11 | 3.02 | 0.32 | 0.40 | — | Balance | 77 | 93 | 20.6 |
| Embodiment 5-13 | 7.05 | 3.13 | 0.48 | 0.39 | — | Balance | 76 | 95 | 17.4 |
| Embodiment 5-14 | 7.08 | 2.88 | 0.26 | 0.052 | — | Balance | 77 | 92 | 13.2 |
| Embodiment 5-15 | 7.03 | 3.20 | 0.29 | 0.23 | — | Balance | 77 | 94 | 17.2 |
| Embodiment 5-16 | 7.09 | 3.14 | 0.26 | 0.59 | — | Balance | 77 | 96 | 19.4 |
| Embodiment 5-17 | 7.01 | 3.12 | 0.28 | 0.78 | — | Balance | 76 | 93 | 18.3 |
| Embodiment 5-18 | 7.04 | 3.09 | 0.28 | 0.41 | 0.037 | Balance | 77 | 94 | 21.6 |

TABLE 5-1-continued

| | Components of Ag alloy (% by weight) | | | | | | Electrical conductivity | Hardness | Endurance switching cycles |
|---|---|---|---|---|---|---|---|---|---|
| | Sn | In | Cu | Te | Ni | Ag + Impurities | (% IACS) | (Hv) | ($\times 10^3$) |
| Embodiment 5-19 | 7.02 | 3.07 | 0.29 | 0.39 | 0.29 | Balance | 77 | 94 | 24.3 |
| Embodiment 5-20 | 7.10 | 3.02 | 0.26 | 0.41 | 0.37 | Balance | 77 | 95 | 22.8 |
| Embodiment 5-21 | 7.07 | 2.97 | 0.26 | 0.38 | 0.46 | Balance | 77 | 97 | 21.0 |

TABLE 5-2

| | Components of Ag alloy (% by weight) | | | | | Electrical conductivity | Hardness | Endurance switching cycles |
|---|---|---|---|---|---|---|---|---|
| | Sn | In | Cu | Te | Ag + Impurities | (% IACS) | (Hv) | ($\times 10^3$) |
| Comparative Embodiment 5-1 | 5.11 | 3.20 | 0.28 | — | Balance | 71 | 105 | 0.6 |
| Comparative Embodiment 5-2 | 6.02 | 3.24 | 0.25 | — | Balance | 70 | 108 | 1.9 |
| Comparative Embodiment 5-3 | 7.11 | 3.18 | 0.29 | — | Balance | 68 | 112 | 3.6 |
| Comparative Embodiment 5-4 | 8.09 | 3.15 | 0.26 | — | Balance | 67 | 116 | 2.5 |
| Comparative Embodiment 5-5 | 8.98 | 3.31 | 0.29 | — | Balance | 65 | 117 | 2.0 |
| Comparative Embodiment 5-6 | 7.05 | 1.53 | 0.26 | — | Balance | 71 | 106 | 0.7 |
| Comparative Embodiment 5-7 | 6.96 | 2.18 | 0.28 | — | Balance | 70 | 108 | 1.4 |
| Comparative Embodiment 5-8 | 7.03 | 4.04 | 0.27 | — | Balance | 67 | 112 | 2.7 |
| Comparative Embodiment 5-9 | 7.06 | 4.98 | 0.28 | — | Balance | 65 | 115 | 2.4 |
| Comparative Embodiment 5-10 | 6.88 | 3.07 | 0.053 | — | Balance | 68 | 109 | 2.9 |
| Comparative Embodiment 5-11 | 7.02 | 3.11 | 0.13 | — | Balance | 68 | 108 | 3.1 |
| Comparative Embodiment 5-12 | 7.01 | 3.16 | 0.38 | — | Balance | 68 | 113 | 3.5 |
| Comparative Embodiment 5-13 | 7.04 | 3.12 | 0.49 | — | Balance | 68 | 111 | 2.5 |

The metallographic structure of various electrical contacts thus obtained was observed by using a scanning electron microscope (magnification: 20,000 times).

Figure 5:
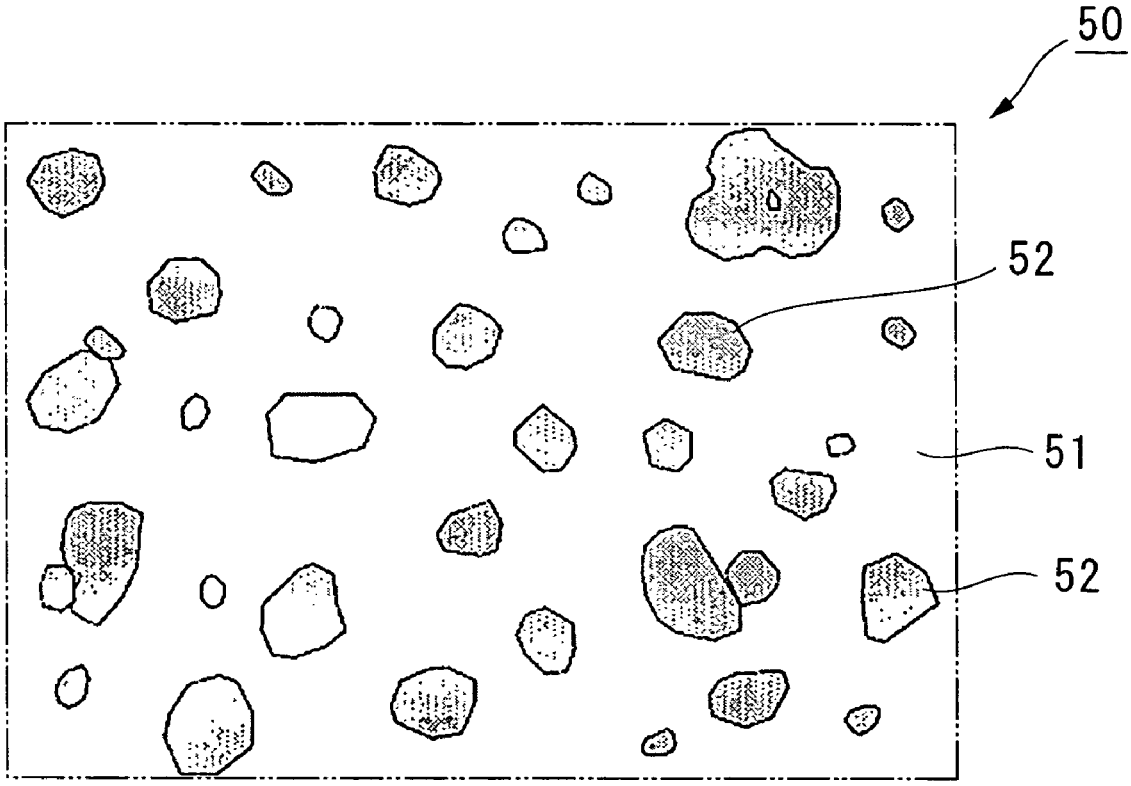
FIG. 5 is a schematic view showing a metallographic structure (magnification: 20,000 times) of an electrical contact of Embodiment 5-3 according to the fifth aspect of the present invention.
Figure 6A:
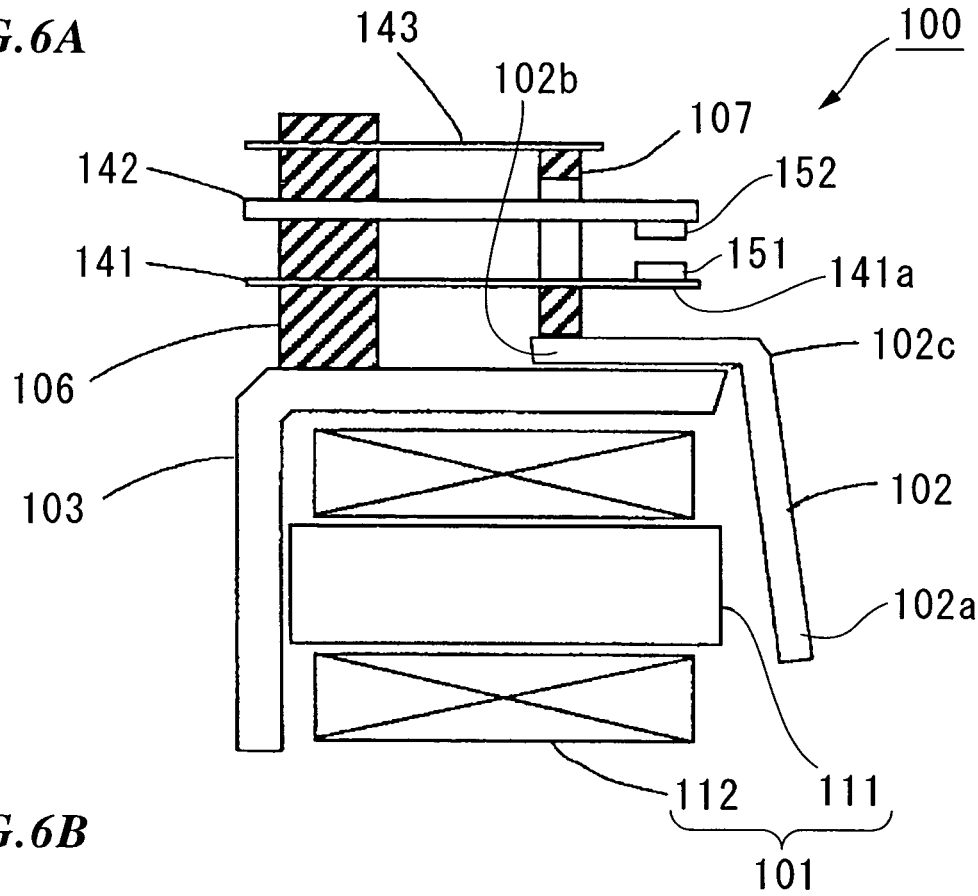
FIG. 6A is a schematic longitudinal sectional view showing an example of an electromagnetic relay in the inactive state.
Figure 6B:
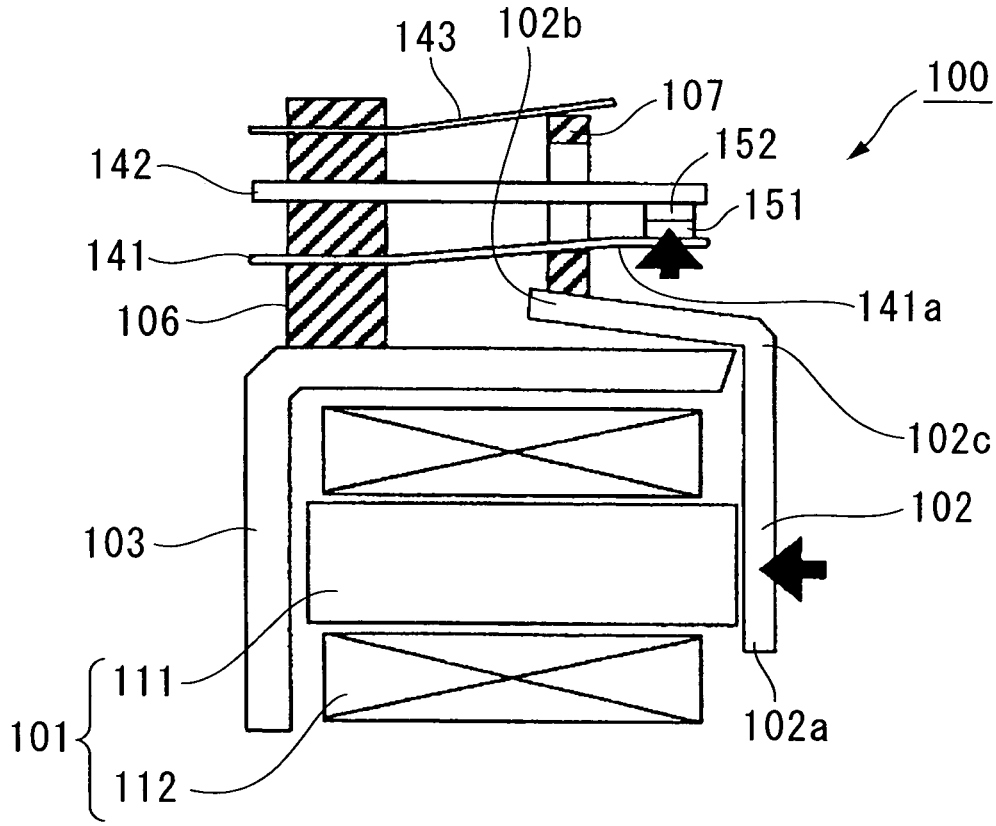
FIG. 6B is a schematic longitudinal sectional view showing an example of an electromagnetic relay in the active state.
Figure 11:
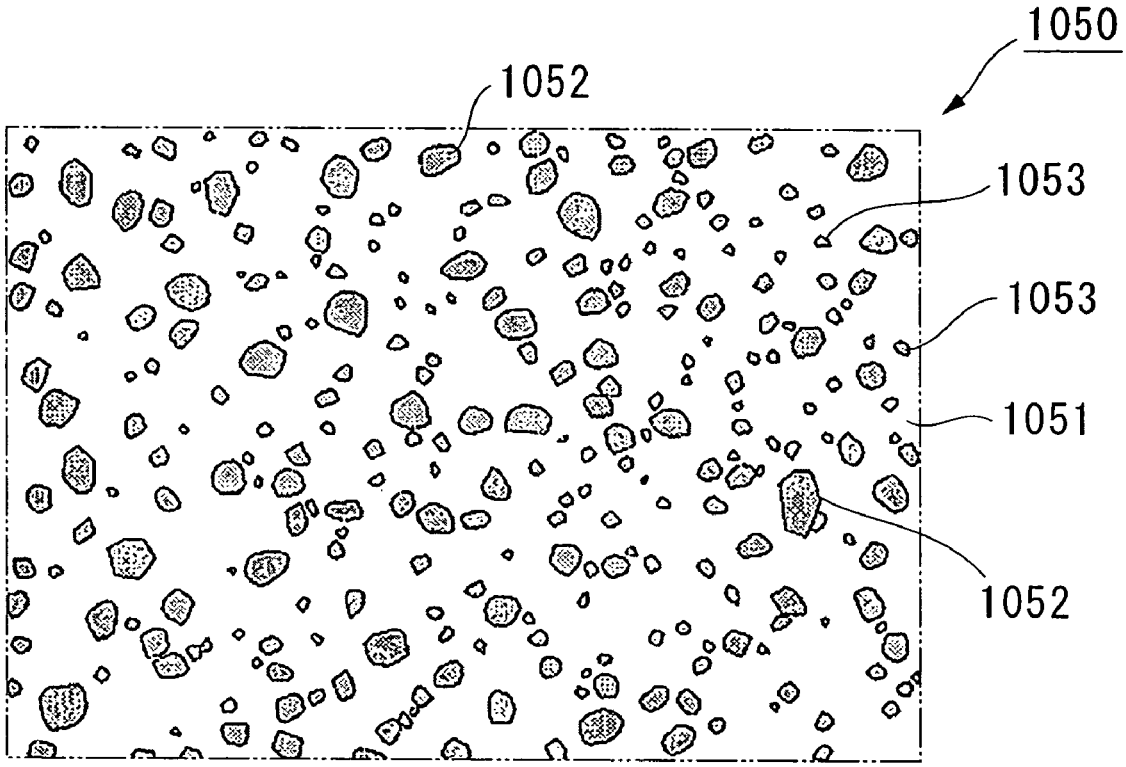
FIG. 11 is a schematic view showing a metallographic structure (magnification: 20,000 times) of a conventional electrical contact of Comparative Embodiment 5-3.

FIG. 5 is a schematic view showing a metallographic structure of an electrical contact of Embodiment 5-3 according to the fifth aspect of the present invention, and FIG. 11 is a schematic view showing a metallographic structure of a conventional electrical contact of Comparative Embodiment 5-3.

In any of electrical contacts 50 of Embodiments 5-1 to 5-21, ultra-fine particles of Sn-based oxides and In-based oxides do not exist in the state of being precipitated by the internal oxidation treatment. It has been found that, in any of electrical contacts 50 of Embodiments 5-1 to 5-21, the material constituting the electrical contact has a metallographic structure such that coarse grains of composite oxides 52 are dispersed and distributed in an Ag matrix 51, the coarse grains of composite oxides 52 being formed as a result of coarsening of ultra-fine grains of oxides, which are precipitated by the internal oxidation treatment, by the heat treatment for diffusion, aggregation, and growth of the precipitated oxides.

In contrast, in any of conventional electrical contacts 1050 of Comparative Embodiments 5-1 to 5-13, the material constituting the electrical contact has a metallographic structure such that ultra-fine particles of Sn-based oxides 1052 and In-based oxides 1053 exist in an Ag matrix 1051 in the state of being precipitated by the internal oxidation treatment.

The electrical contacts of different types described above were subjected to switching test with an ASTM electrical contact tester under the following conditions, to determine the number of switching cycles performed before failure (Endurance switching cycles).

Motor lock loading method
Power voltage: 14 VDC
Rated current: 30 A
Contact closing force: 15 gf
Contact opening force: 15 gf These results are shown in Table 5-1 and Table 5-2.

For the purpose of evaluating the electrical conductivity of the electrical contacts, measurement results of electrical conductivity (% IACS) are shown in Table 5-1 and Table 5-2 and also measurement results of Microvickers hardness (Hv) are also shown.

In the electrical contacts of Embodiments 5-1 to 5-21, as described above, ultra-fine particles of Sn-based oxides and In-based oxides do not exist in the Ag matrix in the state of being precipitated by the internal oxidation treatment, and the ultra-fine particles of these oxides diffuse, aggregate, and grow into coarse grains of composite oxides. As is apparent from the results shown in Table 5-1 and Table 5-2, any of the electrical contacts of Embodiments 5-1 to 5-21 has excellent electrical conductivity. Therefore, heat generation between the contacts is significantly suppressed. As a result, softening of the electrical contact by the heating thereof is suppressed and excellent durability against fusing of the contacts can be maintained. Consequently, the head diameter of the rivet-shape is reduced to 2.3 mm and thus a very long service life can be obtained in an on-off test under service conditions at high current density.

In contrast, in the electrical contacts of Comparative Embodiments 5-1 to 5-13, as described above, ultra-fine particles of Sn-based oxides and In-based oxides are dispersed and distributed in the Ag matrix in the state of being precipitated by the internal oxidation treatment, thus any of them has low electrical conductivity. Therefore, greater heat generation occurs between the contacts under service conditions at high current density, thus making it difficult to maintain excellent welding resistance, eventually reaching the end of service life in a relatively short period of time.

As described above, the electrical contacts according to the fifth aspect of the present invention demonstrates excellent electrical contact characteristics over a long period of time, that is, high welding resistance and high wear resistance, even if greater current density per unit area is caused by size reduction, and is therefore suitable for an electromagnetic relay which is made smaller in size.

The present invention can be utilized as electrical contacts for various electromagnetic relays which are used in automobile, office equipment, etc.

What is claimed is:

1. An electrical contact having high electrical conductivity for a compact electromagnetic relay, comprising:

an internally oxidized and heat treated silver-oxide material which is prepared by subjecting an Ag alloy having a composition consisting essentially of, by weight, 5.1 to 9% Sn, 1.5 to 5% In, and 0.05 to 0.8% Te with the balance being Ag and unavoidable impurities, to an internal oxidation treatment and then subjecting to a heat treatment for diffusion, aggregation, and growth of precipitated oxides;

wherein the internal oxidation of the Ag alloy produces a metallographic structure such that ultra-fine grains of Sn-based oxides and In-based oxides are dispersed and distributed in an Ag matrix, the heat treatment of the internally oxidized silver oxide material changes the metallographic structure such that coarse grains of composite oxides are formed as a result of coarsening of the ultra-fine grains of Sn-based oxides and the ultra-fine grains of In-based oxides, which are precipitated by the internal oxidation treatment, by the heat treatment for diffusion, aggregation, and growth of the precipitated oxides, and the heat treatment is conducted at a temperature ranging from 900° C. to 960° C. in an air atmosphere here for between 10 to 20 hours.

2. An electrical contact having high electrical conductivity for a compact electromagnetic relay, comprising:

an internally oxidized and heat treated silver-oxide material which is prepared by subjecting an Ag alloy having a composition consisting essentially of, by weight, 5.1 to 9% Sn, 1.5 to 5% In, 0.05 to 0.8% Te, and 0.03 to 0.5% Ni with the balance being Ag and unavoidable impurities, to an internal oxidation treatment and then subjecting to a heat treatment for diffusion, aggregation, and growth of precipitated oxides;

wherein the internal oxidation of the Ag alloy produces a metallographic structure such that ultra-fine grains of Sn-based oxides and In-based oxides are dispersed and distributed in an Ag matrix, the heat treatment of the internally oxidized silver oxide material changes the metallographic structure such that coarse grains of composite oxides are formed as a result of coarsening of the ultra-fine grains of Sn-based oxides and the ultra-fine grains of In-based oxides, which are precipitated by the internal oxidation treatment, by the heat treatment for diffusion, aggregation, and growth of the precipitated oxides, and the heat treatment is conducted at a temperature ranging from 900° C. to 960° C. in an air atmosphere for between 10 to 20 hours.

3. An electrical contact having high electrical conductivity for a compact electromagnetic relay, comprising:

an internally oxidized and heat treated silver-oxide material which is prepared by subjecting an Ag alloy having a composition consisting essentially of, by weight, 5.1 to 9% Sn, 1.5 to 5% In, 0.05 to 0.5% Cu, and 0.05 to 0.8% Te with the balance being Ag and unavoidable impurities, to an internal oxidation treatment and then subjecting to a heat treatment for diffusion, aggregation, and growth of precipitated oxides;

wherein the internal oxidation of the Ag alloy produces a metallographic structure such that ultra-fine grains of Sn-based oxides and In-based oxides are dispersed and distributed in an Ag matrix, the heat treatment of the internally oxidized silver oxide material changes the metallographic structure such that coarse grains of composite oxides are formed as a result of coarsening of the ultra-fine grains of Sn-based oxides and the ultra-fine grains of In-based oxides, which are precipitated by the internal oxidation treatment, by the heat treatment for diffusion, aggregation, and growth of the precipitated oxides, and the heat treatment is conducted at a temperature ranging from 900° C. to 960° C. in an air atmosphere for between 10 to 20 hours.

4. An electrical contact having high electrical conductivity for a compact electromagnetic relay, comprising:

an internally oxidized and heat treated silver-oxide material which is prepared by subjecting an Ag alloy having a composition consisting essentially of, by weight, 5,1 to 9% Sn, 1.5 to 5% In, 0.05 to 0.5% Cu, 0.05 to 0.8% Te, and 0.03 to 0.5% Ni with the balance being Ag and unavoidable impurities, to an internal oxidation treatment and then subjecting to a heat treatment for diffusion, aggregation, and growth of precipitated oxides;

wherein the internal oxidation of the Ag alloy produces a metallographic structure such that ultra-fine grains of Sn-based oxides and In-based oxides are dispersed and distributed in an Ag matrix, the heat treatment of the internally oxidized silver oxide material changes the metallographic structure such that coarse grains of composite oxides are formed as a result of coarsening of the ultra-fine grains of Sn-based oxides and the ultra-fine grains of In-based oxides, which are precipitated by the internal oxidation treatment, by the heat treatment for diffusion, aggregation, and growth of the precipitated oxides, and the heat treatment is conducted at a temperature ranging from 900° C. to 960° C. in an air atmosphere for between 10 to 20 hours.

5. The electrical contact of claim 1, wherein the internally oxidized and heat treated silver-oxide material has a hardness of less than 97 Hv and a conductivity of at least 75% IACS.

6. The electrical contact of claim 2, wherein the internally oxidized and heat treated silver-oxide material has a hardness of less than 97 Hv and a conductivity of at least 75% IACS.

7. The electrical contact of claim 3, wherein the internally oxidized and heat treated silver-oxide material has a hardness of less than 97 Hv and a conductivity of at least 75% IACS.

8. The electrical contact of claim 4, wherein the internally oxidized and heat treated silver-oxide material has a hardness of less than 97 Hv and a conductivity of at least 75% IACS.

* * * * *